US008777042B2

(12) United States Patent
Matthews et al.

(10) Patent No.: US 8,777,042 B2
(45) Date of Patent: Jul. 15, 2014

(54) DISPOSABLE LINER FOR A COOLER

(76) Inventors: Gina Matthews, Westfield, NC (US); Mark Matthews, Westfield, NC (US)

( * ) Notice: Subject to any disclaimer, the term of this patent is extended or adjusted under 35 U.S.C. 154(b) by 0 days.

(21) Appl. No.: 13/446,367

(22) Filed: Apr. 13, 2012

(65) Prior Publication Data

US 2012/0261422 A1 Oct. 18, 2012

Related U.S. Application Data

(60) Provisional application No. 61/475,583, filed on Apr. 14, 2011.

(51) Int. Cl.
*B65D 25/16* (2006.01)
*F25D 23/06* (2006.01)
*F25D 3/08* (2006.01)

(52) U.S. Cl.
CPC ..... *B65D 25/16* (2013.01); *F25D 23/066* (2013.01); *F25D 3/08* (2013.01); *F25D 2331/804* (2013.01)
USPC ..... 220/495.03

(58) Field of Classification Search
CPC ..... B65D 25/16; B65D 25/14; B65D 90/046; B65D 90/04; A45C 11/20; F25D 3/08; F25D 23/066; F25D 2331/804
USPC ..... 220/495.03, 495.01, 915.2, 915.1; 62/457.7
IPC ..... B65D 25/18,25/16, 25/14, 90/04
See application file for complete search history.

(56) References Cited

U.S. PATENT DOCUMENTS

| | | | | | |
|---|---|---|---|---|---|
| 2,883,046 | A | * | 4/1959 | Weiner | 206/433 |
| 3,347,060 | A | * | 10/1967 | Barkan | 62/457.9 |
| 4,047,633 | A | * | 9/1977 | Trombly | 220/592.2 |
| 4,085,785 | A | * | 4/1978 | Hoot | 220/592.24 |
| 5,097,979 | A | * | 3/1992 | McDermott et al. | 220/495.01 |
| 5,240,134 | A | * | 8/1993 | McDermott et al. | 220/495.03 |
| 5,403,095 | A | * | 4/1995 | Melk | 383/110 |
| 5,616,383 | A | * | 4/1997 | Weder | 428/35.7 |
| 5,941,408 | A | * | 8/1999 | Sherman | 220/495.01 |
| D448,169 | S | * | 9/2001 | Rine et al. | D3/318 |

* cited by examiner

*Primary Examiner* — Robert J Hicks
(74) *Attorney, Agent, or Firm* — W. Kevin Ransom; Moore & Van Allen PLLC

(57) ABSTRACT

A liner for use with a cooler is provided comprising a body forming a containment space. An opening is connected to the containment space, wherein the opening comprises two pairs of opposed sides with adjacent sides connected together by corners, the opening thereby forming either a rectangular or square shape. Further, at least one of the corners has an extended portion extending outwardly from the respective sides associated with the corner. In some embodiments, two or more of the corners has an extended portion extending outwardly from the respective sides associated with the corner. In other embodiments, the liner has a straight edge where none of the corners have an extended portion extending outwardly from the respective sides associated with the corners.

10 Claims, 28 Drawing Sheets

DISPOSABLE LINER FOR A COOLER

CLAIM OF PRIORITY UNDER 35 U.S.C. §119

This Non-provisional Patent Application claims priority to U.S. Provisional Patent Application Ser. No. 61/475,583, filed Apr. 14, 2011, entitled "DISPOSABLE LINER FOR A COOLER.

BACKGROUND

1. Field of the Invention

The present invention relates to disposable liners for coolers.

2. Description of Related Prior Art

Coolers have various uses and are sometimes used as multipurpose containers. While generally used to contain ice, food, and beverages, these containers may also be used for items that can potentially make the container no longer useful for ice, beverage, and food containment. Specifically, sportsman use coolers for bait, caught fish, small prey, etc. Use of the cooler for such items can cause infiltration of odors, bacteria, bodily fluids, etc, into the liner of the cooler.

Coolers can be fairly expensive to replace. Further, personal storage in a home or apartment may be limited. Owning multiple coolers can be cost prohibitive and inconvenient. As such, solutions are needed that allow a cooler to have multiple uses without fouling the cooler.

General purpose liners have been used in the past, such as trash bags. However, trash bags are designed for optimal use in circular trash cans or tall, narrow, rectangular trash cans. These liners are not optimized for cooler dimensions. Further, general purpose liners do not accommodate optimally for coolers with lids. Many coolers have hinges connecting the container to the lid. The hinges are located at the top of the container and do not accommodate for placement of the liner over the rim of the cooler. This, in turn, may create a gap between the liner and inner portion of the cooler that allows for contact between the inner portion of the cooler and the contents.

It has been noted that some existing garbage can liners have flaps spaced along the opening thereof. There are typically two pairs of opposing flaps that are configured to operate as ties for the liners when the liners are full and ready for removal from the trash can. The flaps are spaced at opposed sides of the liner so as to drape over the sides of the garbage can, so that the flaps are more easily grasped. The flaps are not configured to fit over the corners of a trash can having a rectangular shaped opening.

SUMMARY

The following presents a simplified summary of several embodiments of the invention relating to a disposable liner for use with a cooler. For example, in one embodiment of the present invention, a liner is provided that comprises a body forming a containment space. An opening is connected to the containment space, wherein the opening comprises two pairs of opposed sides with adjacent sides connected together by corners, the opening thereby forming either a rectangular or square shape. Further, at least one of the corners has an extended portion extending outwardly from the respective sides associated with the corner. In some embodiments, two or more of the corners has an extended portion extending outwardly from the respective sides associated with the corner.

In some embodiments, the corner having an extended portion has a curved perimeter edge. In other embodiments, the corner having an extended portion has opposed sides that intersect at a distal point creating a generally triangular shape. Still in other embodiments, the corner having an extended portion comprises two opposed sides that intersect with a distal side to thereby form a squared shape. In another embodiment, liner has a straight edge top and none of the corners have an extended portion.

In some embodiments, the liner may further comprise an elongated slot located in at least one of the opposed sides of the opening to thereby accommodate a strap of the cooler connecting the lid to the opening in the cooler.

BRIEF DESCRIPTION OF THE DRAWINGS

The present invention is further described in the detailed description which follows in reference to the figures.

DETAILED DESCRIPTION OF EMBODIMENTS OF THE INVENTION

Figure 1:
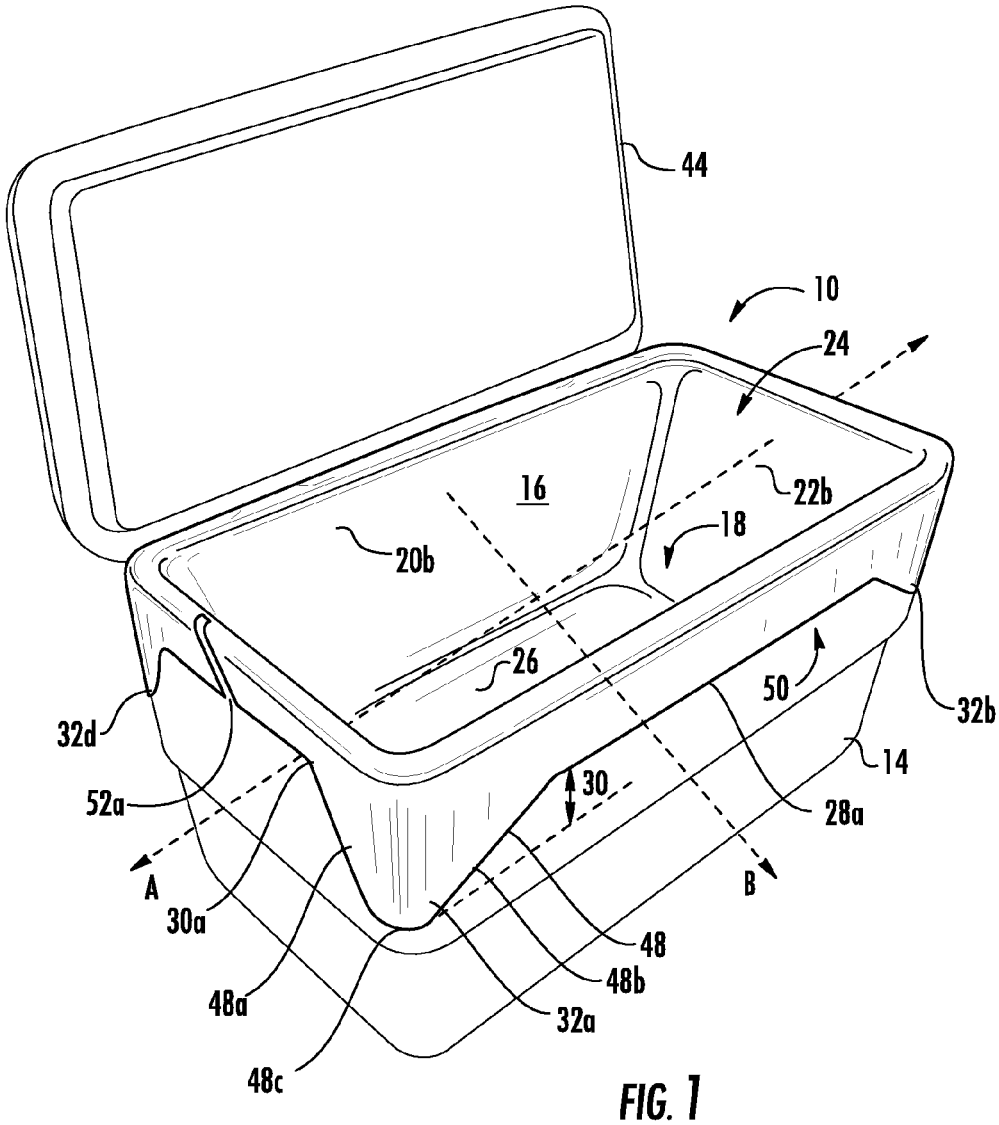
FIG. 1 is a perspective view of a first embodiment of a liner according to the present invention.
Figure 2:
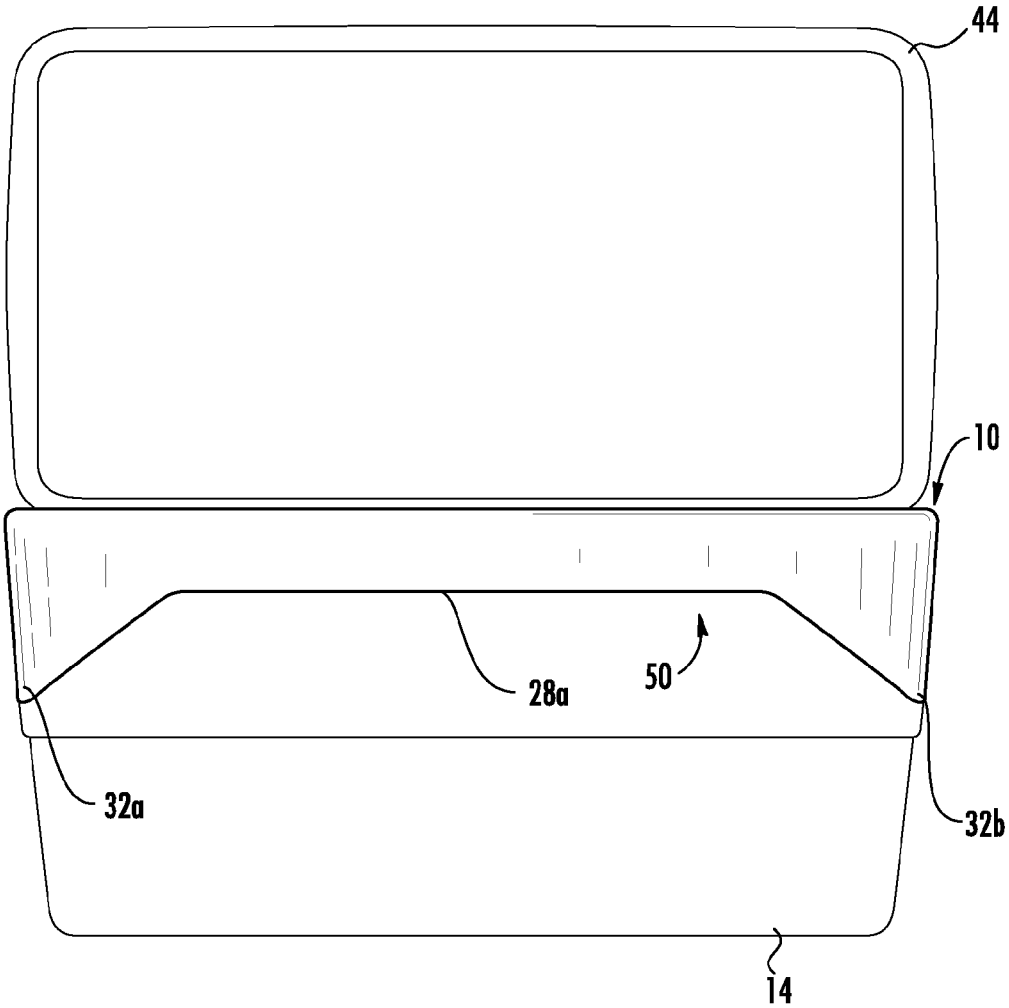
FIG. 2 is an elevational view of the front side of the liner of FIG. 1.

Embodiments of the present invention now may be described more fully hereinafter with reference to the accompanying drawings, in which some, but not all, embodiments of the invention are shown. Indeed, the invention may be embodied in many different forms and should not be construed as limited to the embodiments set forth herein; rather, these embodiments are provided so that this disclosure may satisfy applicable legal requirements. Like numbers refer to like elements throughout.

Where possible, any terms expressed in the singular form herein are meant to also include the plural form and vice versa, unless explicitly stated otherwise. Also, as used herein, the term "a" and/or "an" shall mean "one or more," even though the phrase "one or more" is also used herein. Furthermore, when it is said herein that something is "based on" something else, it may be based on one or more other things as well. In other words, unless expressly indicated otherwise, as used herein "based on" means "based at least in part on" or "based at least partially on."

While the foregoing disclosure discusses illustrative embodiments, it should be noted that various changes and modifications could be made herein without departing from the scope of the described aspects and/or embodiments as defined by the appended claims. Furthermore, although elements of the described aspects and/or embodiments may be described or claimed in the singular, the plural is contemplated unless limitation to the singular is explicitly stated. Additionally, all or a portion of any embodiment may be utilized with all or a portion of any other embodiment, unless stated otherwise.

It is noted that the liners described herein are described in an in-use or deployed environment as opposed to a stored environment. Thus, the description below should not limit an understanding of the liners in a folded, stored environment. For example, sides of the liner may be illustrated and described below as in a parallel orientation when in the deployed environment, but it is understood that the sides may be in a different orientation when folded and stored.

With reference to FIGS. 1-9, an embodiment of a liner 10 according to one embodiment of the present invention is illustrated in the context of a cooler 14. The liner 10 includes a body 16. The body 16 defines an inner containment space 18 defined by opposed side walls, 20*a*,20*b*,22*a*,22*b*, an opening 24, and a closed end 26. The opposed side walls 20*a*,20*b*,22*a*,22*b* are defined by a first side edge, a second side edge, a top edge, and a bottom edge. The first pair of side walls 20*a*,20*b* extend along a first axis A of the liner. The second pair of side walls 22*a*,22*b* extend along a second axis B of the liner. Opposed side walls 20*a*,20*b* intersect with opposed side walls 22*a*,22*b* at their first and second side edges. Opposed sides walls 20*a*,20*b*,22*a*,22*b* intersect with the closed end 26 at their bottom edges. In one embodiment, the dimensions of the inner containment space 18 may be 28"×16"×33" in length, width, and height respectively. As such, a liner of these dimensions may accommodate a 42-75 quart cooler. In another embodiment, the dimensions of the inner containment space 18 may be 42"×22"×47" in length, width, and height respectively. As such, a liner of these dimensions may accommodate a 75-150 quart cooler. The opening 24 of the liner is defined by a perimeter 50 having two opposed first sides 28*a*,28*b* that both extend along a first axis A of the liner and are generally parallel to each other when the liner is in a deployed environment. The perimeter also includes two opposed second sides 30*a*,30*b* that both extend along a second axis B of the liner and are generally parallel to each other when the liner is in a deployed environment. First opposed sides 28*a*,28*b* intersect with second opposed side 30*a* at opposite corners 32*a*,32*d* respectively. First opposed sides 28*a*,28*b* intersect with second opposed side 30*b* at opposite corners 32*b*,32*c* respectively.

As illustrated, the underlying cooler 14 has an opening 34 (see FIG. 8) defined by four walls 36*a*-36*d*. The perimeter of the liner is configured to drape over, overlap, or cover top edges of the four walls 36*a*-36*d* of the cooler, such that the liner is located in the cooler, with the opening 24 of the liner overlying the opening 34 of the cooler 14. As the perimeter of the liner drapes over, overlaps or covers the top of the four walls of the cooler, a portion of the perimeter engages the outer walls 36*a*-36*d* of the cooler 14 thereby maintaining the liner 10 in place relative to the cooler opening 34 when items are placed in to the containment space 18 of the liner 10.

As illustrated, the corners 32*a*-32*d* may have a shape and surface area for aiding in contact of the perimeter of the liner 10 with the walls 36*a*-36*d* of the cooler 14. With reference to FIGS. 1-9, the corners 32*a*-32*d* of one embodiment extend outwardly from the respective sides of the perimeter of the liner 10. (Note that while FIGS. 1-27 show all corners having an extended dimension, depending on the embodiment, one, two, three, four or all could have the extended dimension but not all corners are required to have such an extended dimension). For example, as illustrated in FIG. 1, the corner 32*a* has an elongated dimension 48 extending outward from intersecting first opposed side 28*a* and second opposed side 30*a*. This elongated dimension 48 creates added surface area for engaging the corners 40*a*-40*d* (see FIG. 8) and outer walls 36*a*-36*d* of the cooler 14 thereby increasing the stability of the liner 10 in the cooler. The elongated dimensions in the corner areas of the cooler aid in prevention of separation of the liner 10 from the cooler when items are placed in the containment space 18 of the liner thereby protecting the cooler 14 from the items in the liner 10.

In the depicted embodiment, the liner 10 has corners 32*a*-32*d* with an elongated dimension 48 defined by opposed sides 48*a*,48*b* that intersect with a distal point 48*c* to thereby form a triangular shape. The triangle shaped corners 32*a*-32*d*, at a minimum, provide added surface area to secure the liner 10 to the cooler 14.

As illustrated in FIGS. 1-9, in some embodiments, an adhesive layer may be provided on the outer side of the perimeter of the opening 24 of the liner 10 to adhere the liner to the walls 36*a*-36*d* and/or corners 40*a*-40*d* of the cooler 14. In the illustrated embodiments, adhesive 42 (see FIG. 9) may be applied in areas in the corners 32*a*-32*d* of the liner 10. The adhesive is chosen so as to be sufficient to adhere to the cooler 14 but also releasable when the liner is removed from the cooler. Adhesive may be located along the entire perimeter of the liner 10 or only in selected areas as shown in FIGS. 1-9. Adhesive may be located along the perimeter of the liner 10 in the areas where the liner 10 will endure the most tension when items are placed in the containment space 18. The adhesive could be provided with a releasable cover that is removed prior to installation so as to protect the adhesive and prevent adherence to the liner during storage. It is understood that other structures for adhering the liner perimeter to the cooler are contemplated other than adhesive, such as Velcro® or other similar connecting mechanism.

Figure 3:
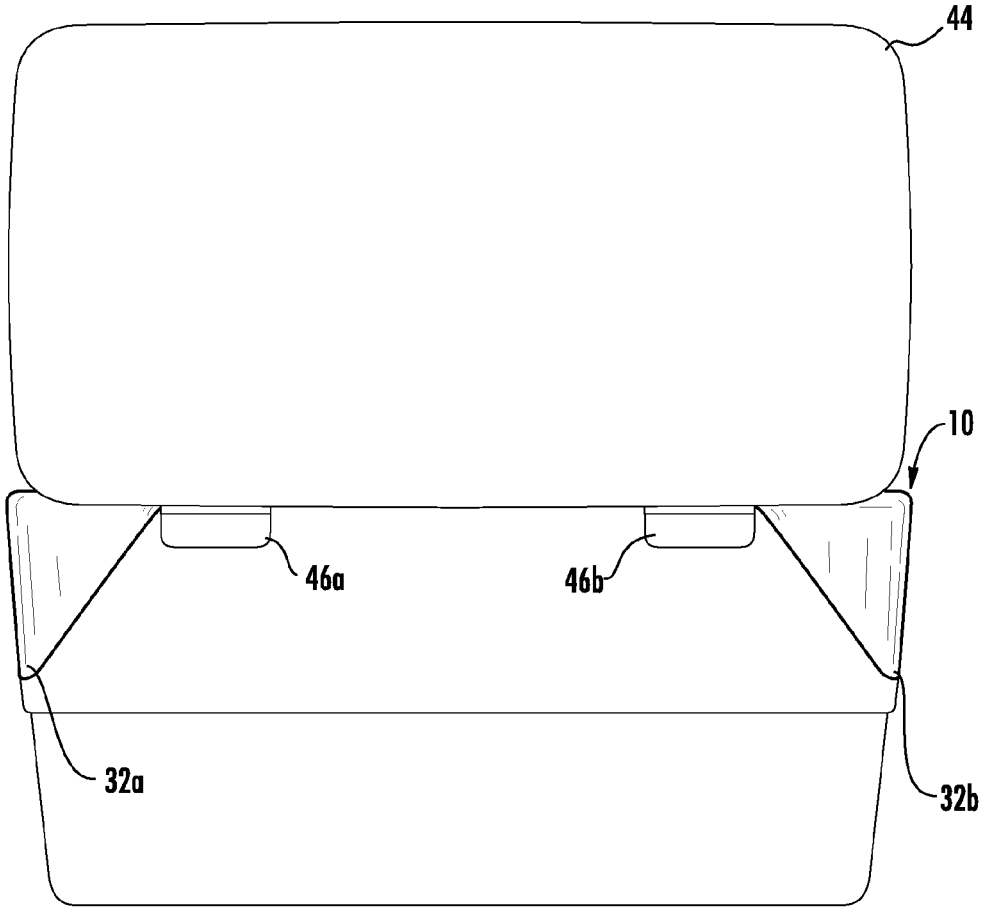
FIG. 3 is an elevational view of the rear side of the liner of FIG. 1.

With reference to FIG. 3, a benefit of the elongated corners 32*c*,32*d* is illustrated. In some embodiments, the liner 10 is configured to accommodate for coolers have lids connected by hinges to the body of the coolers. For example, as illustrated the cooler 14 has a lid 44 connected to the cooler body by hinges 46*a*,46*b*. As illustrated, the first opposed side 28*b* and the corners 32*c*,32*d* form an indented or concave profile in the perimeter 50 of the liner 10. This indented or concave profile accommodates for the hinges 46*a*,46*b* of the cooler, while the elongated corners 32*c*,32*d* provide surface area for contacting the outer corners 40*c*,40*d* of the cooler 14. Thus, the liner 10 is adhered to the cooler 14 and accommodates for the hinges of the cooler.

Figure 5:
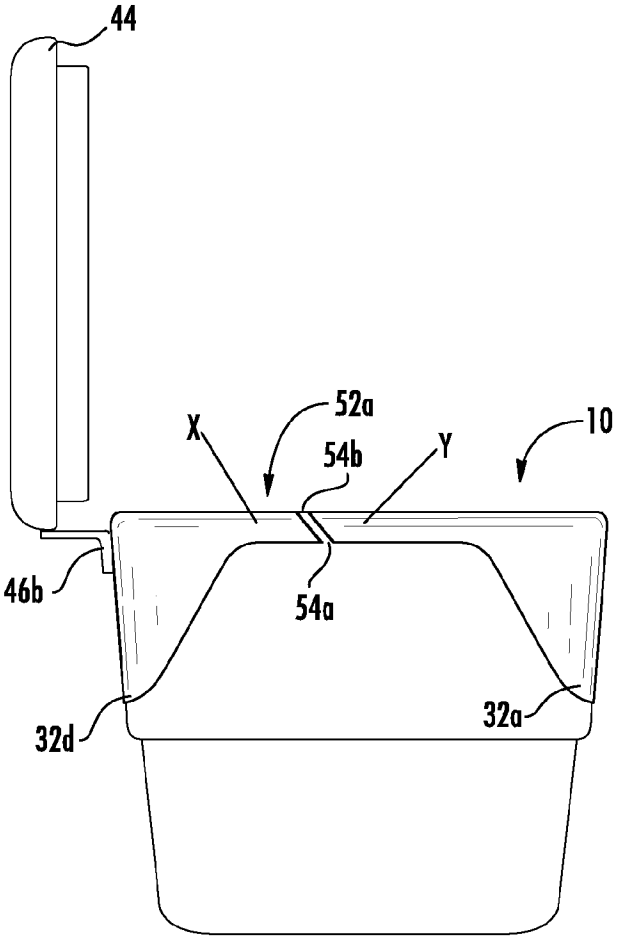
FIG. 5 is an elevational view of the left side of the liner of FIG. 1.
Figure 6:
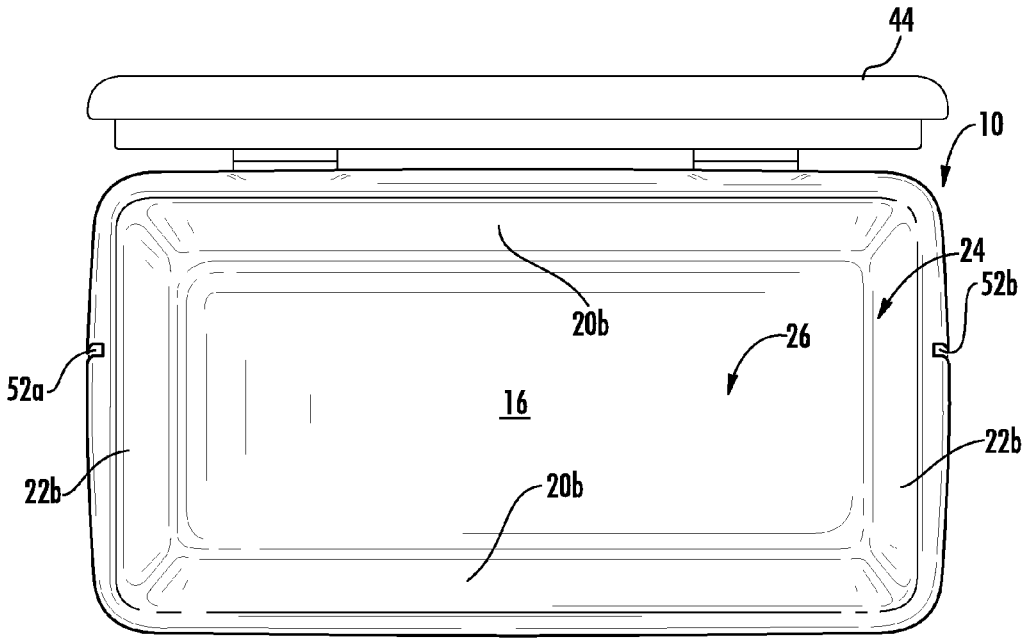
FIG. 6 is a plan view of the top side of the liner of FIG. 1.
Figure 7:
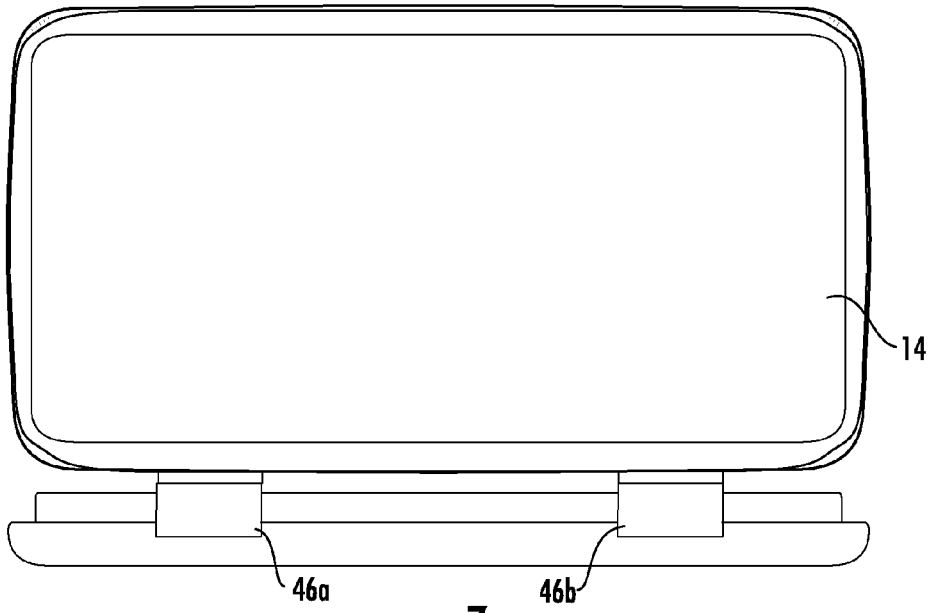
FIG. 7 is a plan view of the bottom side of the liner of FIG. 1.
Figure 8:
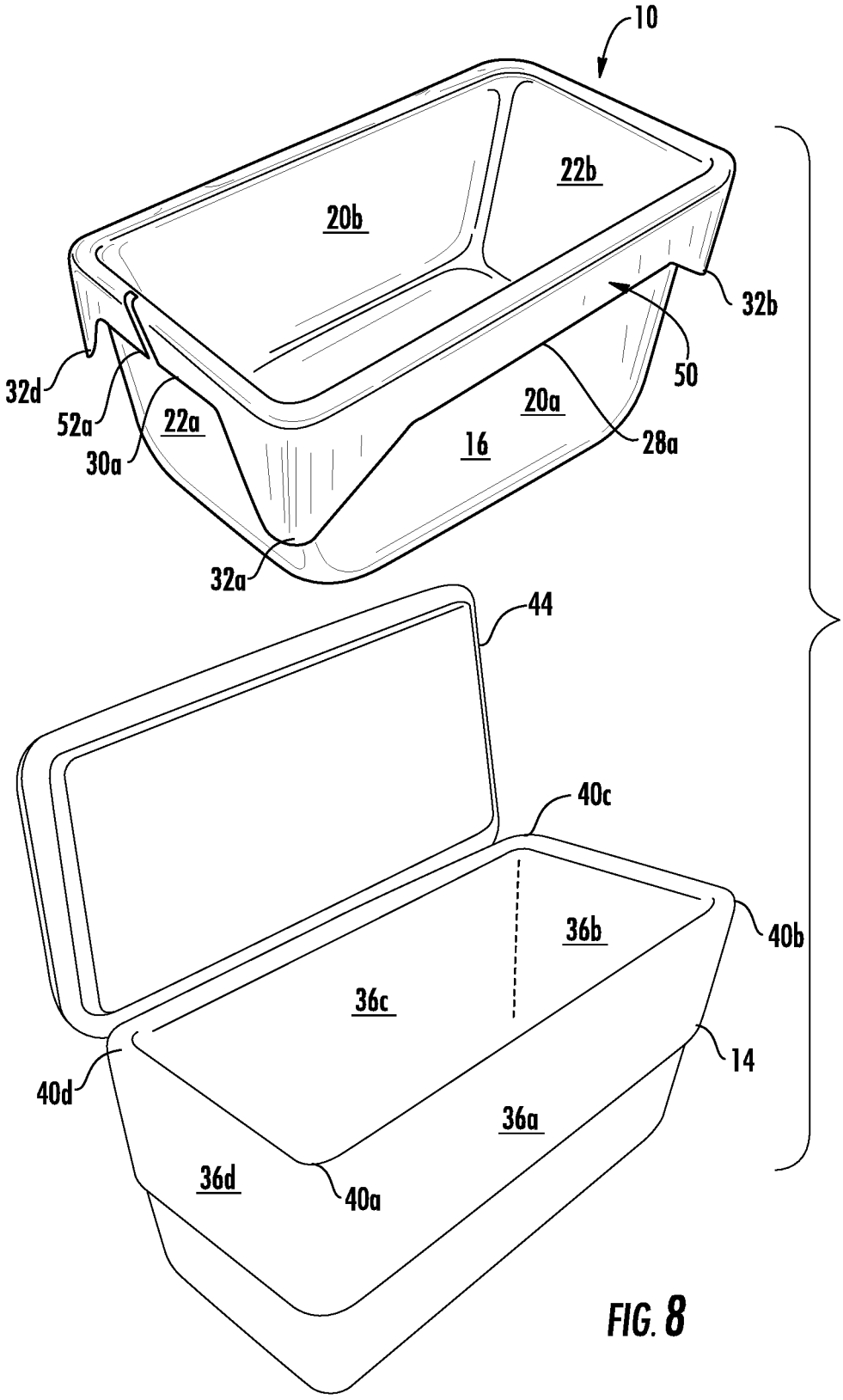
FIG. 8 is an exploded, perspective view of the liner of FIG. 1 viewed from an upper perspective.
Figure 9:
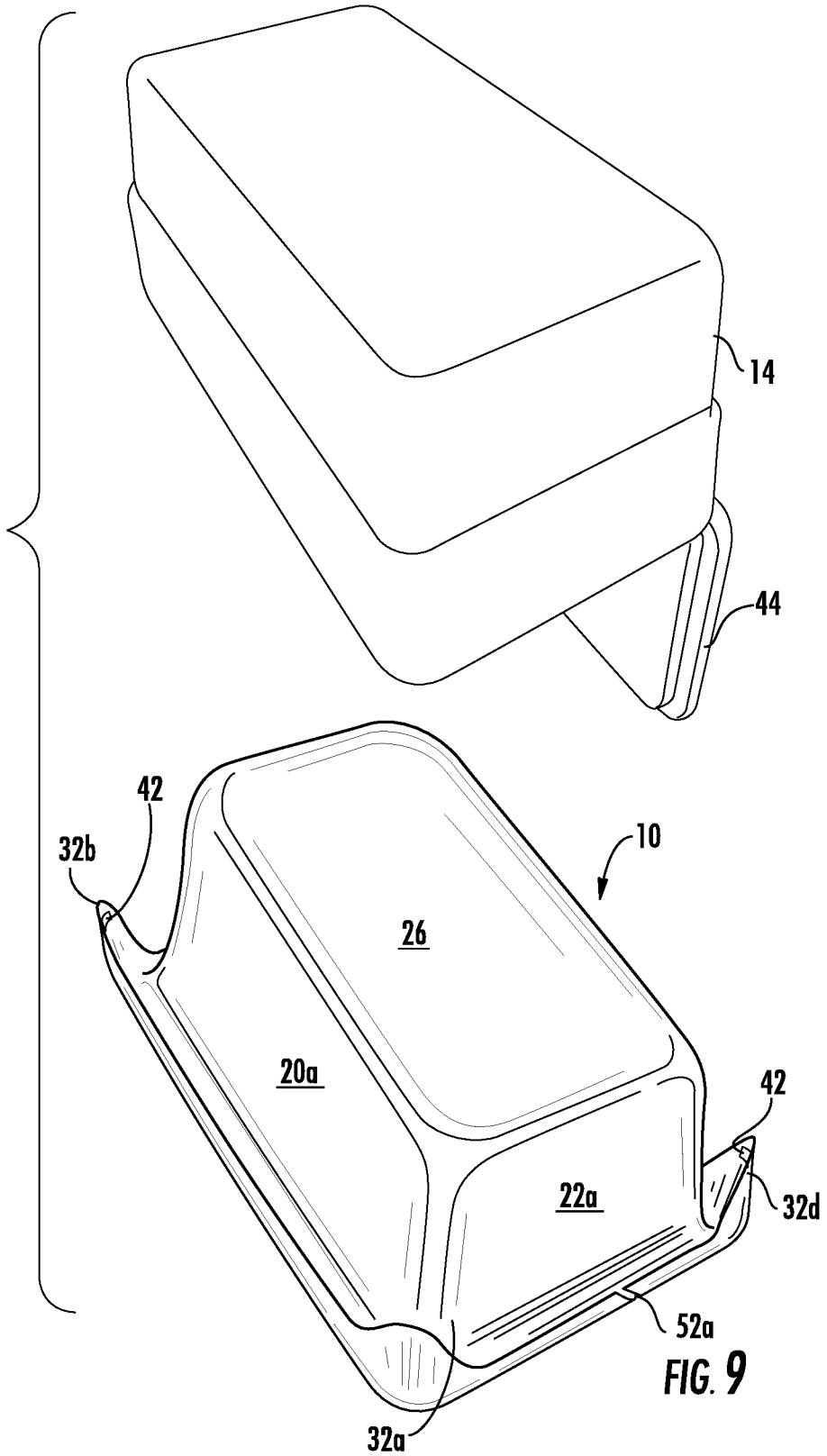
FIG. 9 is an exploded, perspective view of the liner of FIG. 1 viewed from a lower perspective.
Figure 10:
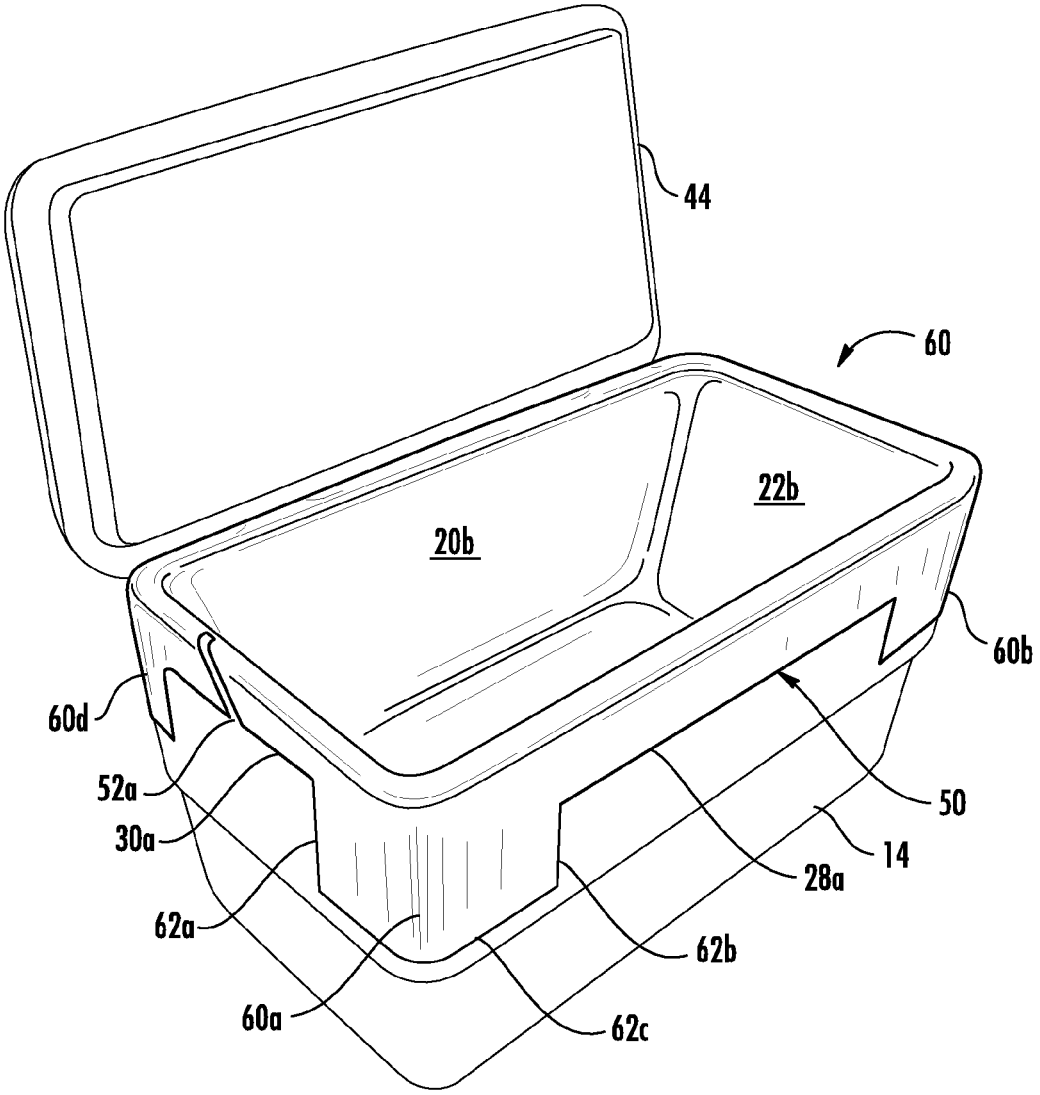
FIG. 10 is a perspective view of a second embodiment of a liner according to the present invention.
Figure 11:
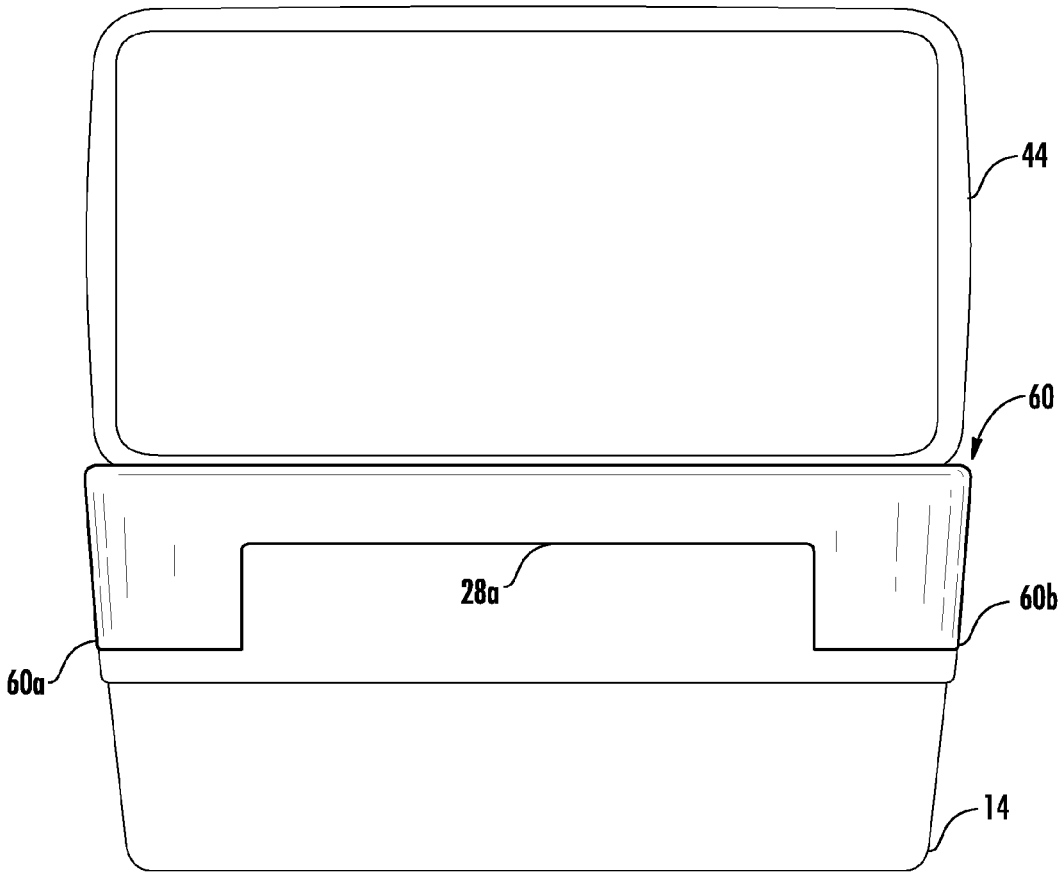
FIG. 11 is an elevational view of the front side of the liner of FIG. 10.
Figure 12:
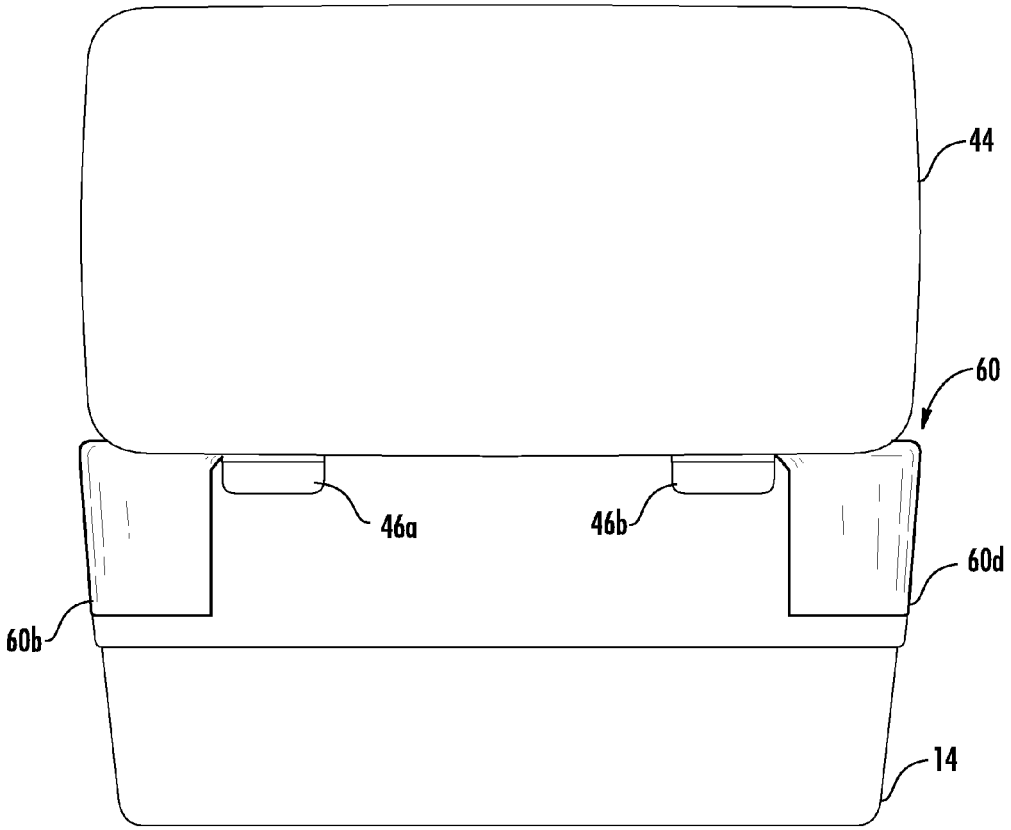
FIG. 12 is an elevational view of the rear side of the liner of FIG. 10.
Figure 14:
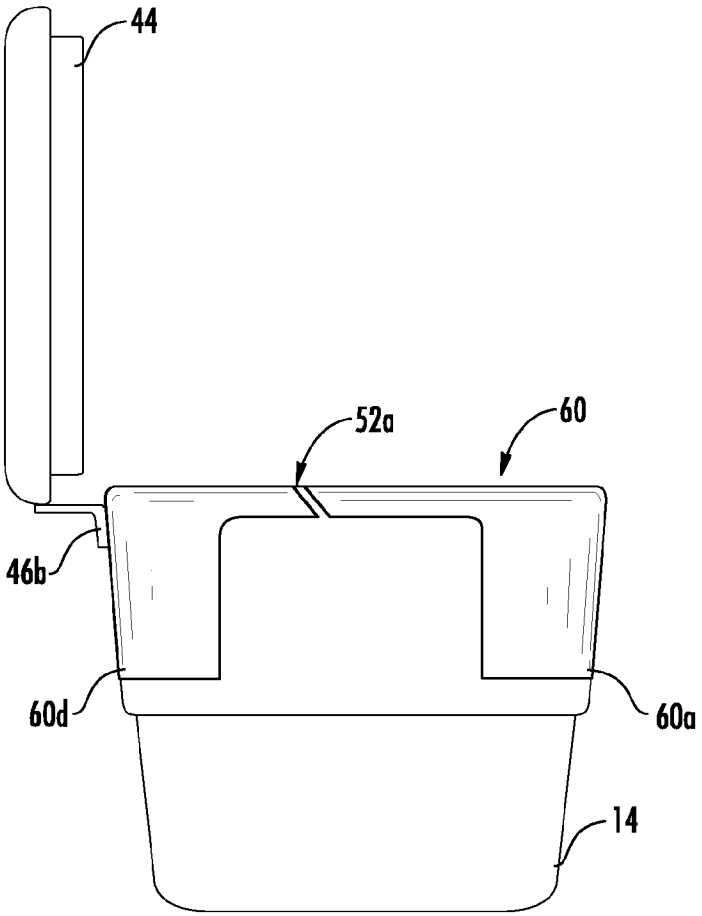
FIG. 14 is an elevational view of the left side of the liner of FIG. 10.
Figure 13:
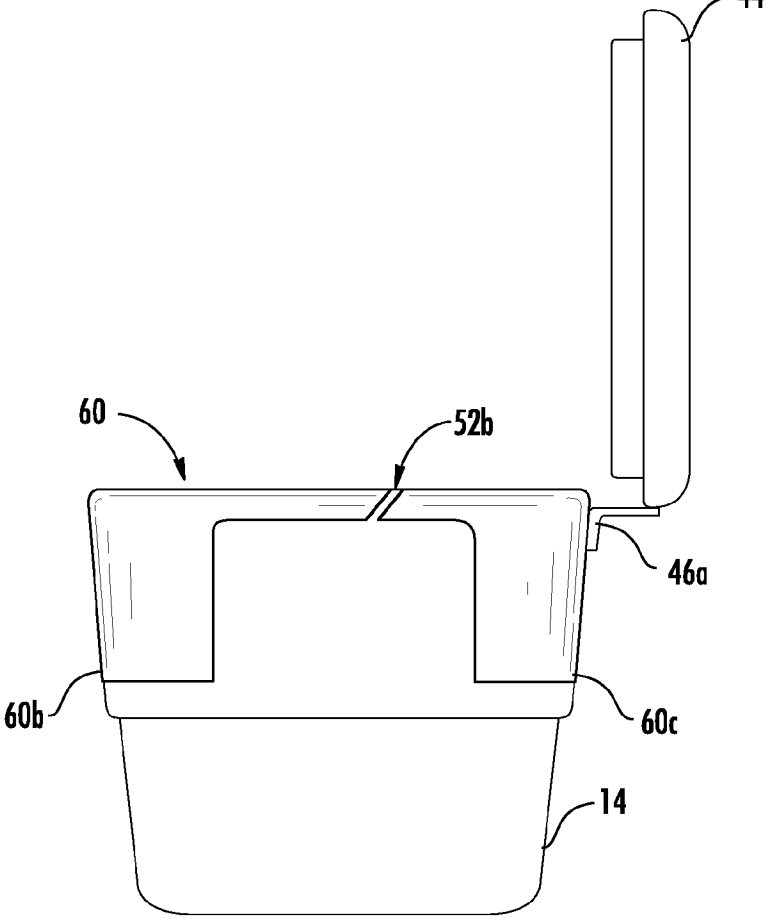
FIG. 13 is an elevational view of the right side of the liner of FIG. 10.
Figure 15:
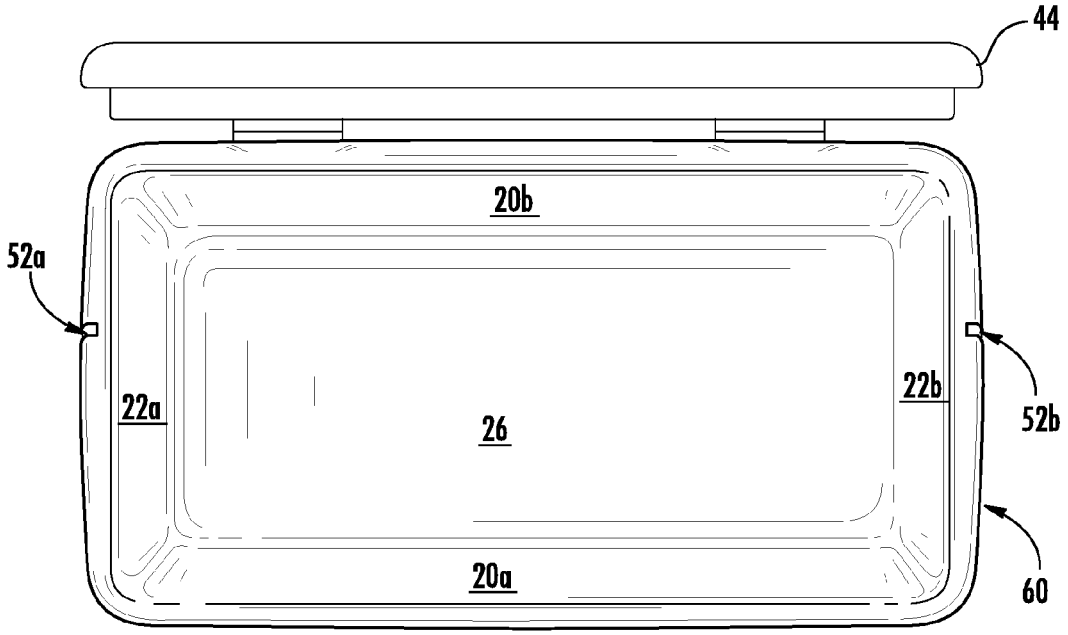
FIG. 15 is a plan view of the top side of the liner of FIG. 10.
Figure 16:
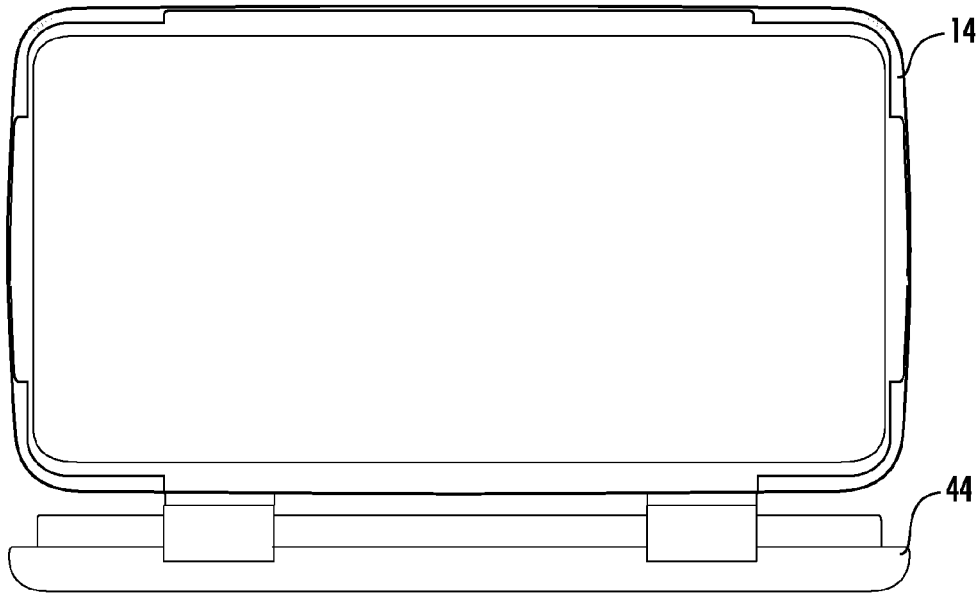
FIG. 16 is a plan view of the bottom side of the liner of FIG. 10.
Figure 17:
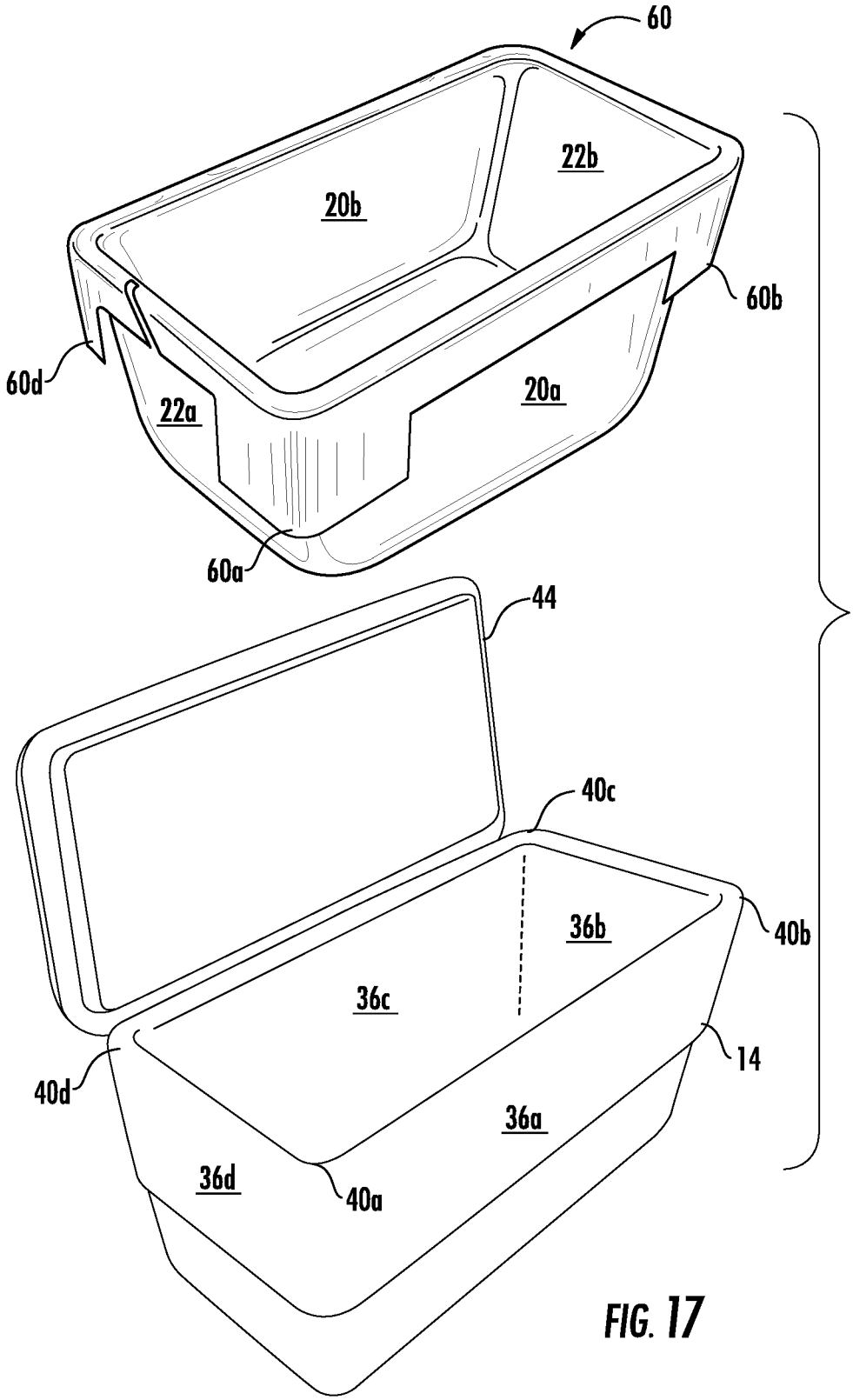
FIG. 17 is an exploded, perspective view of the liner of FIG. 10 viewed from an upper perspective.
Figure 18:
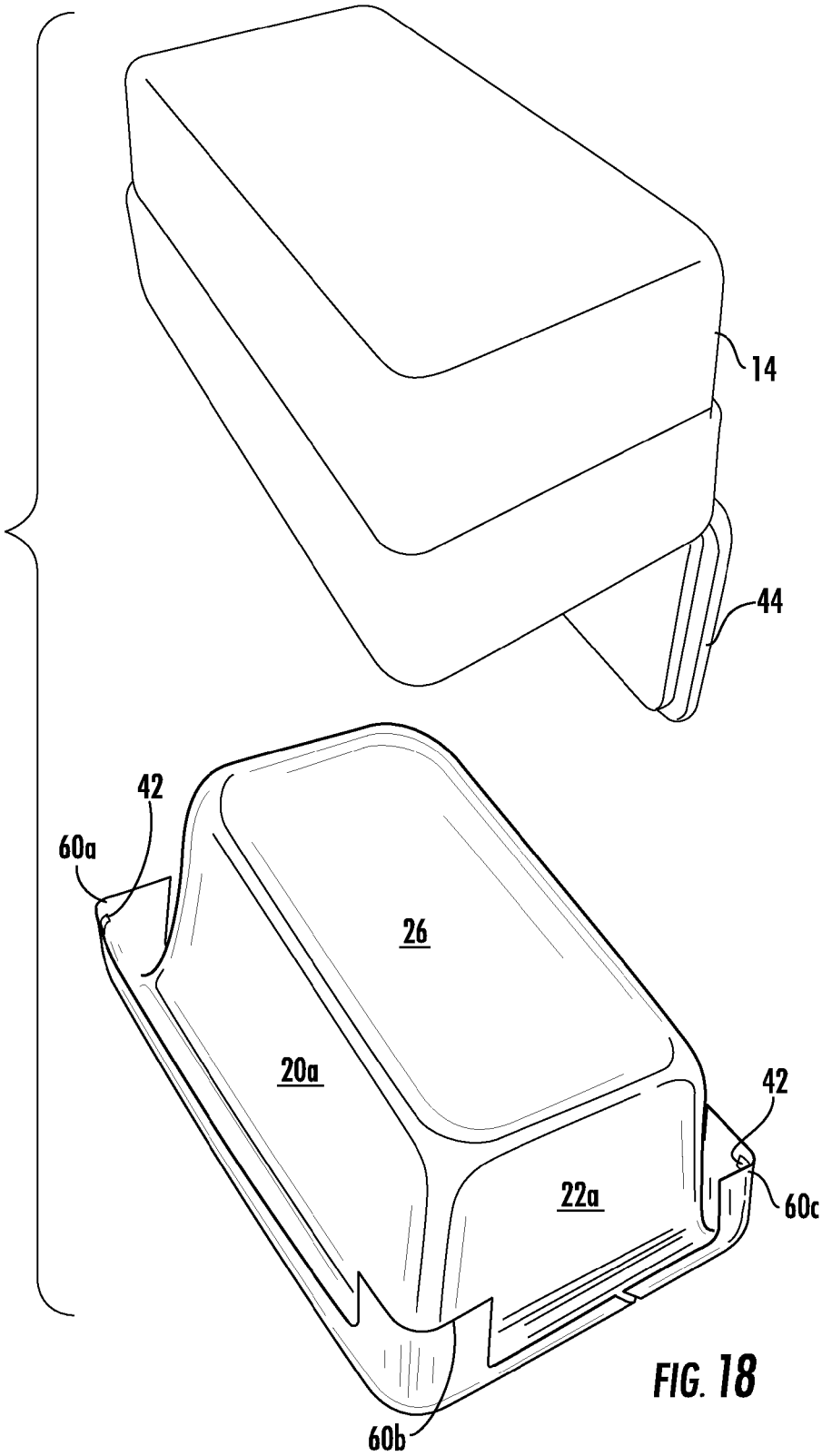
FIG. 18 is an exploded, perspective view of the liner of FIG. 10 viewed from a lower perspective.
Figure 19:
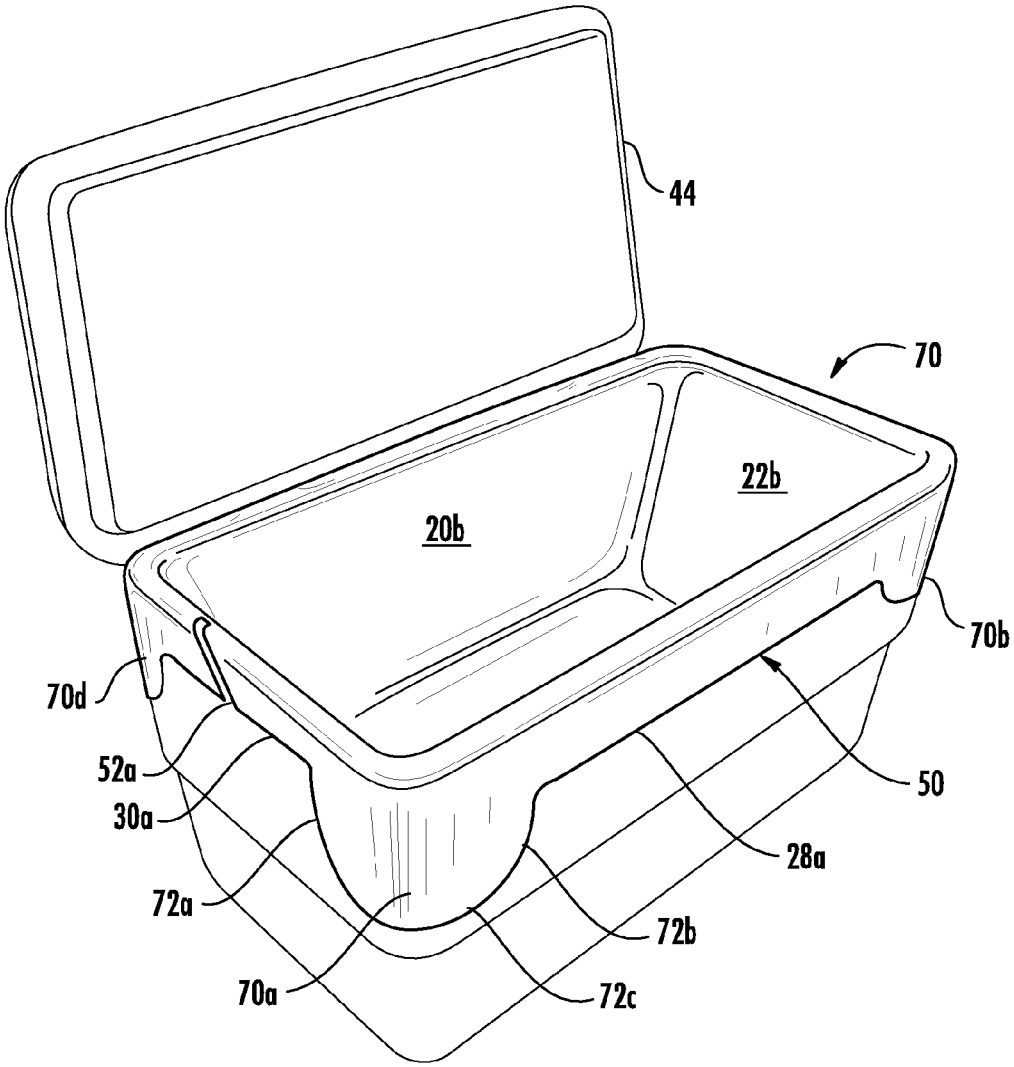
FIG. 19 is a perspective view of a third embodiment of a liner according to the present invention.
Figure 20:
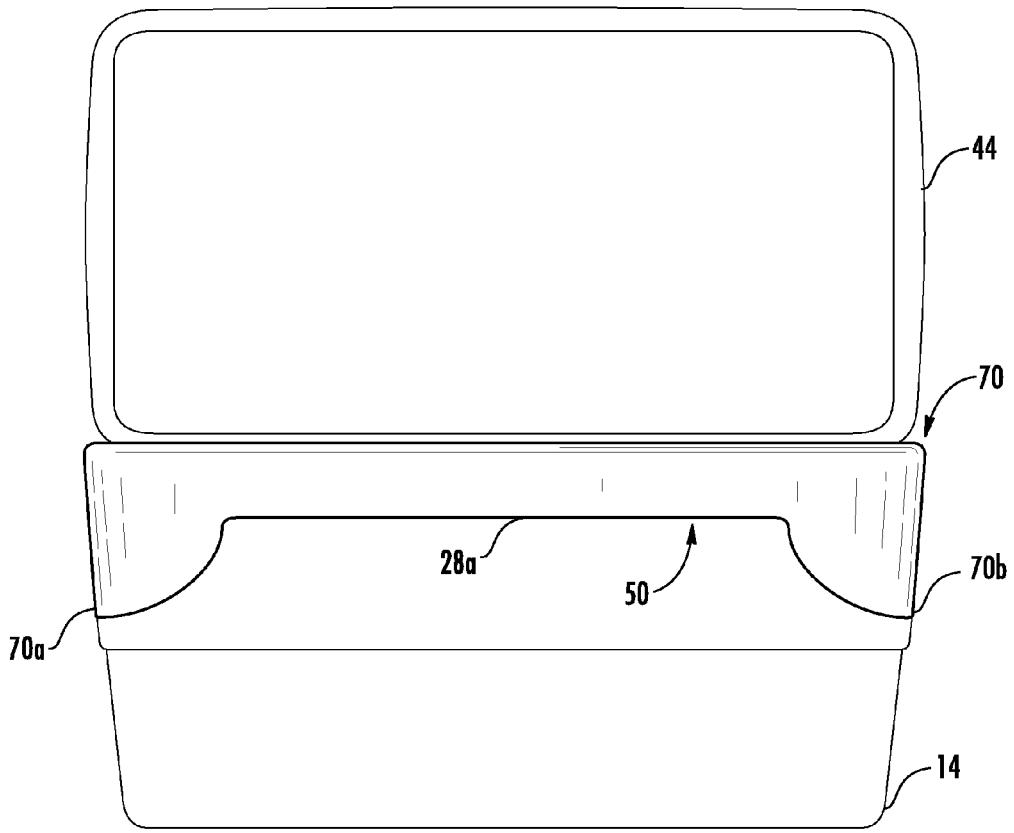
FIG. 20 is an elevational view of the front side of the liner of FIG. 19.
Figure 21:
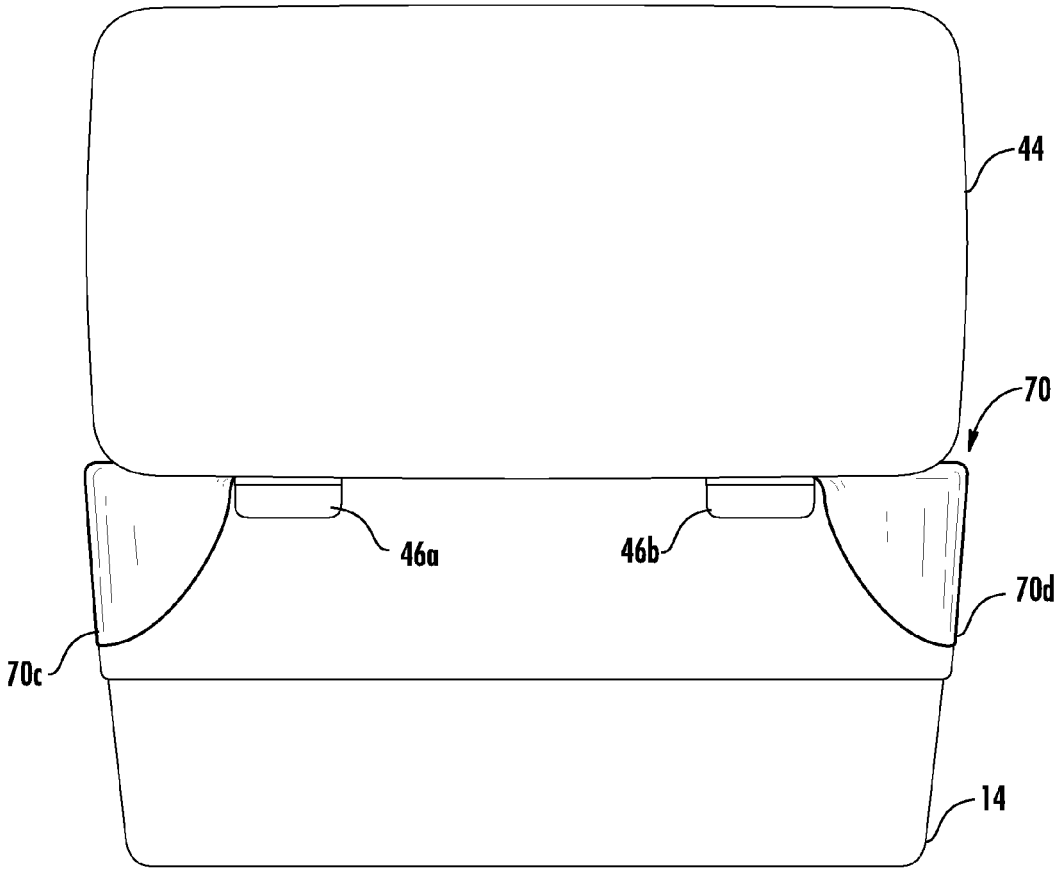
FIG. 21 is an elevational view of the rear side of the liner of FIG. 19.
Figure 23:
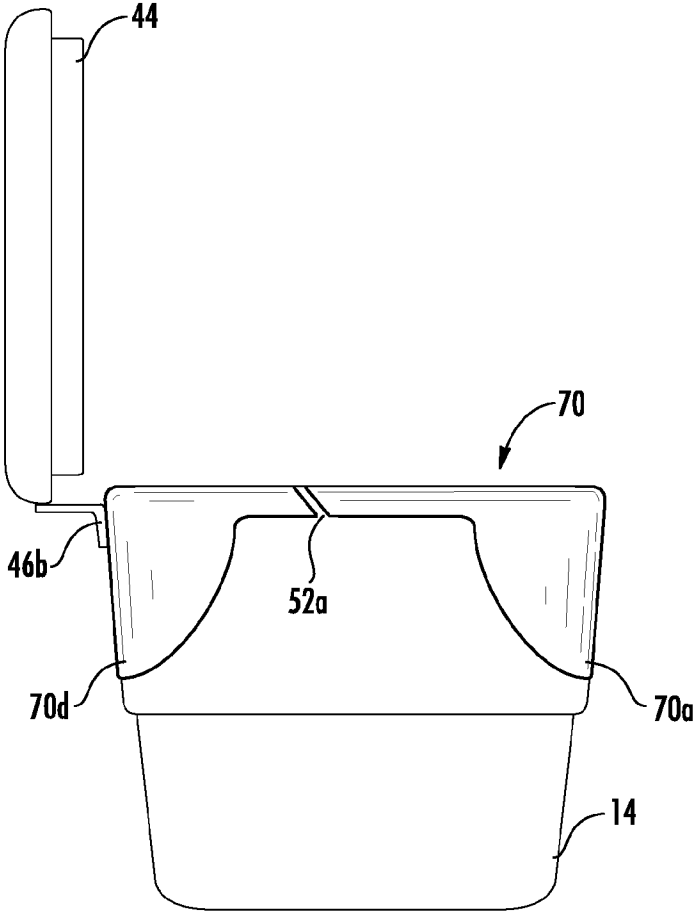
FIG. 23 is an elevational view of the left side of the liner of FIG. 19.
Figure 22:
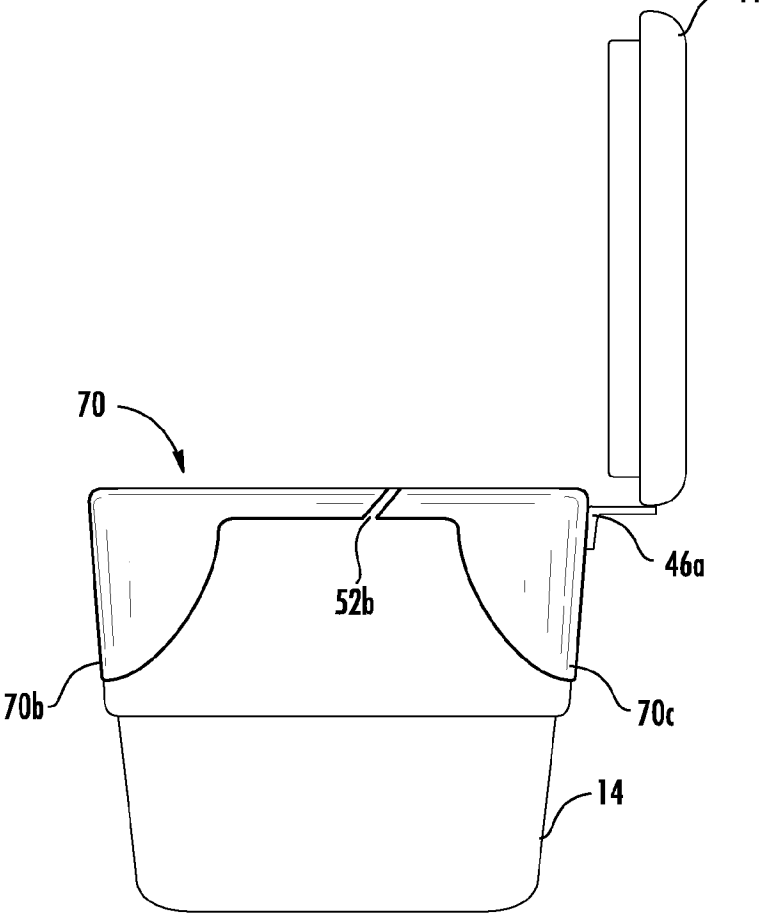
FIG. 22 is an elevational view of the right side of the liner of FIG. 19.
Figure 24:
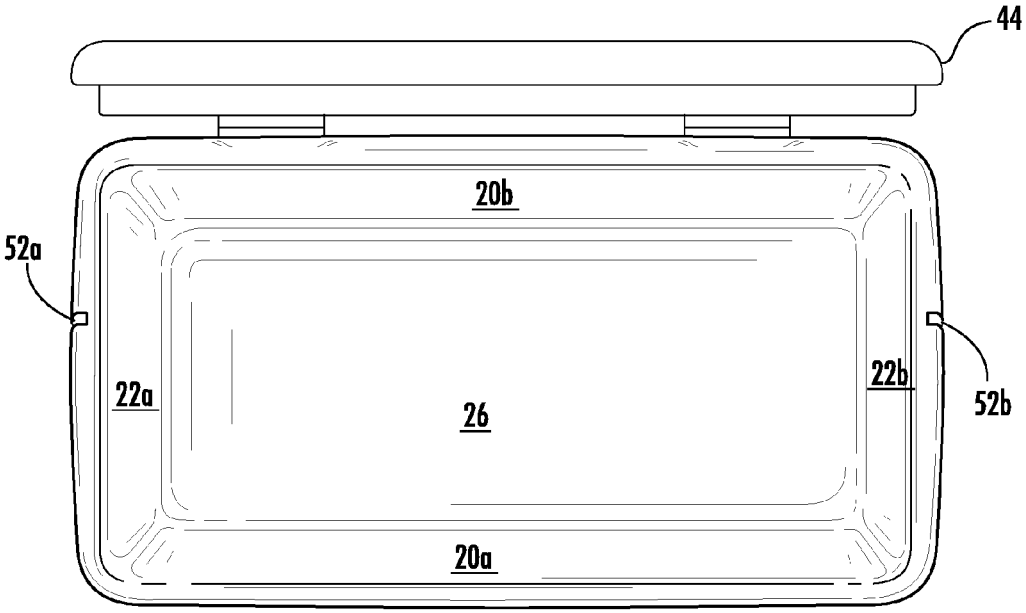
FIG. 24 is a plan view of the top side of the liner of FIG. 19.
Figure 25:
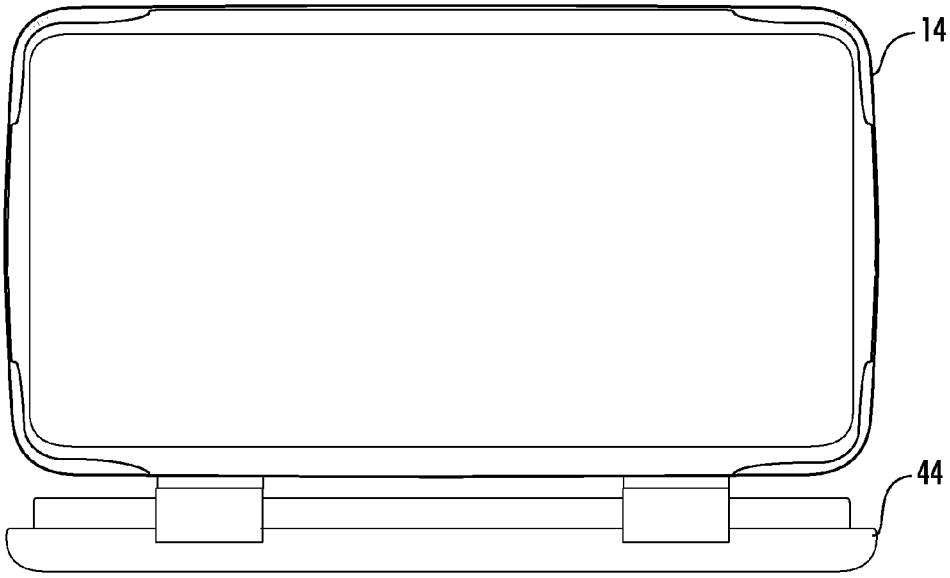
FIG. 25 is a plan view of the bottom side of the liner of FIG. 19.
Figure 26:
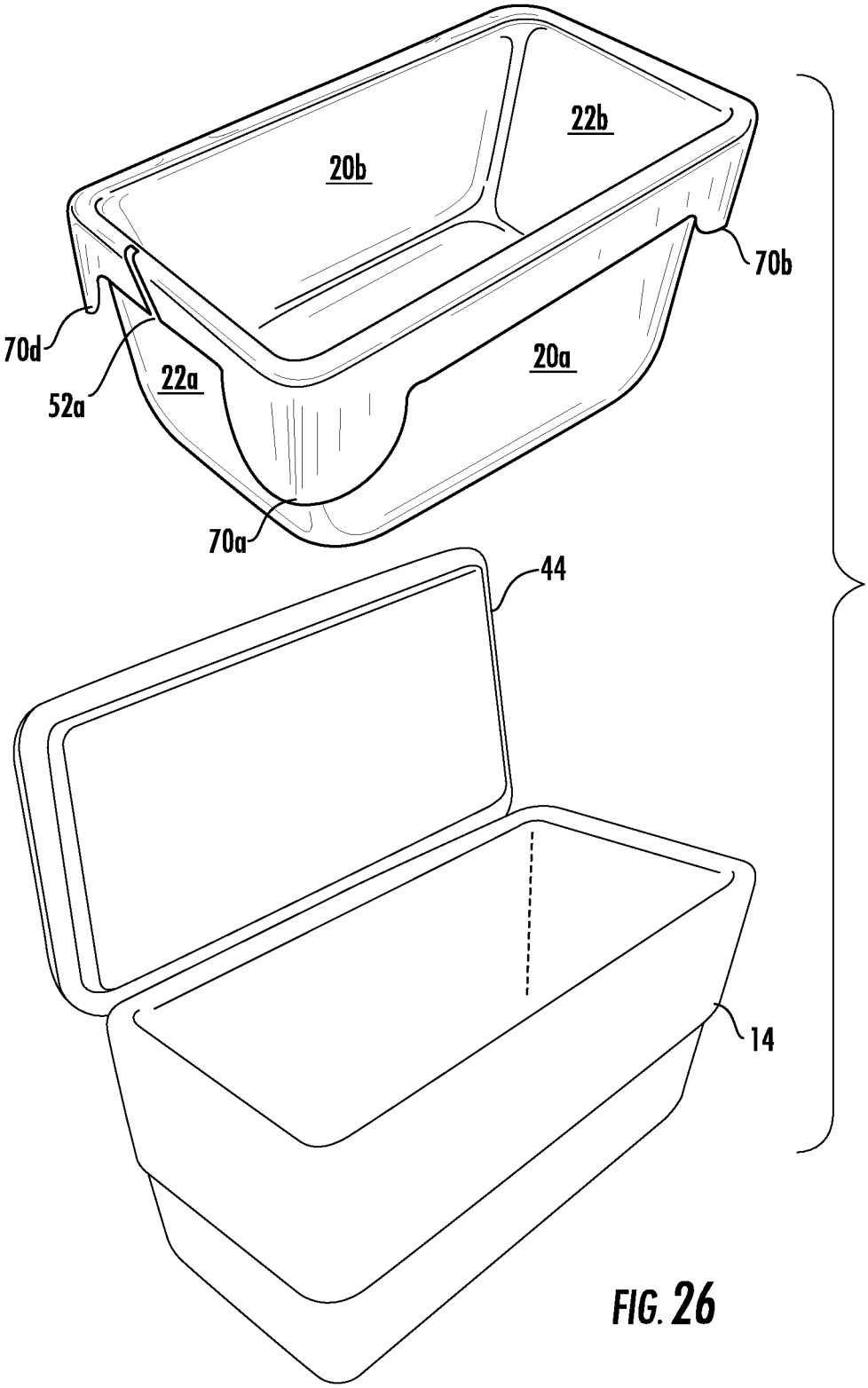
FIG. 26 is an exploded, perspective view of the liner of FIG. 19 viewed from an upper perspective.
Figure 27:
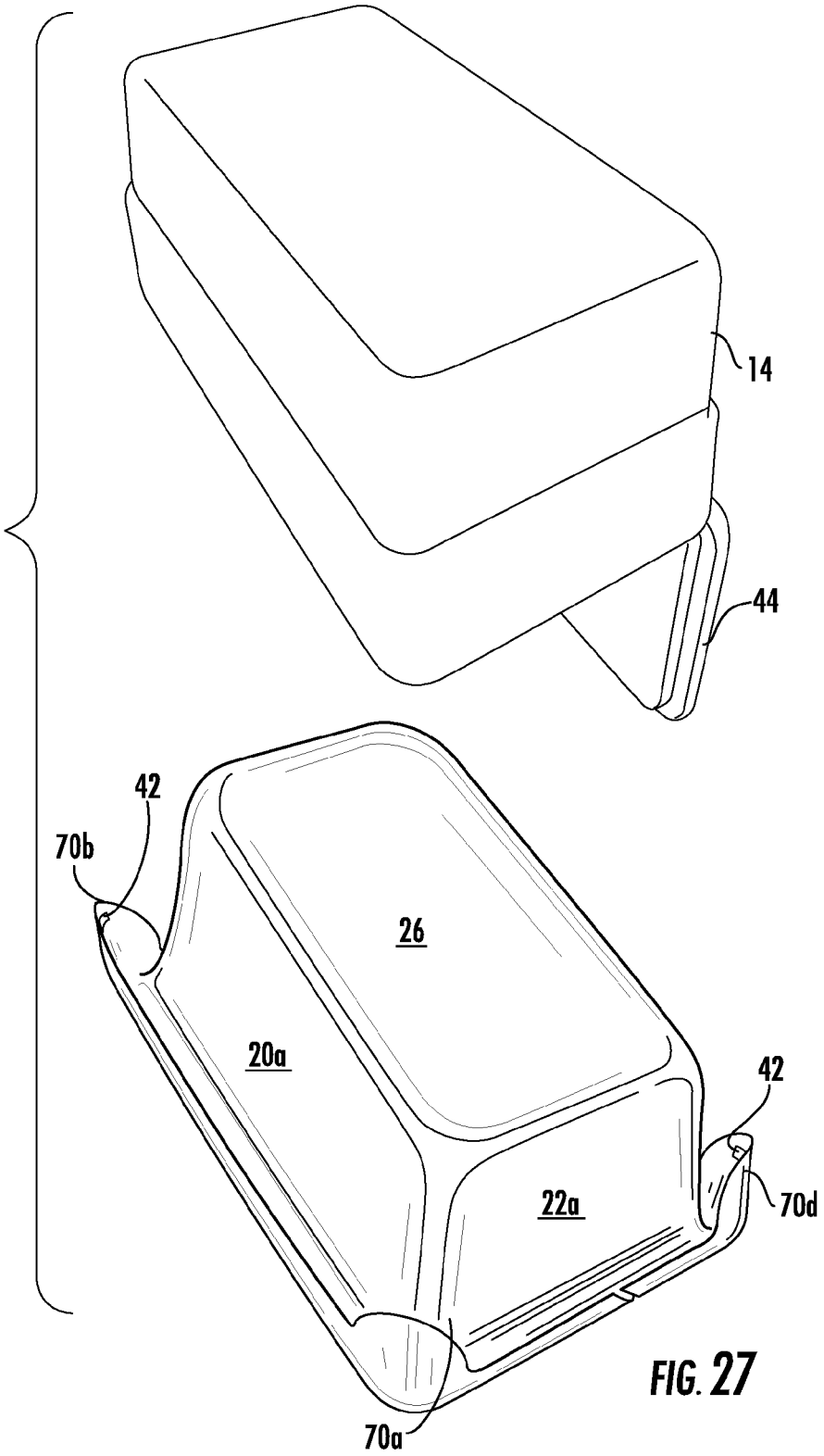
FIG. 27 is an exploded, perspective view of the liner of FIG. 19 viewed from a lower perspective.
Figure 28:
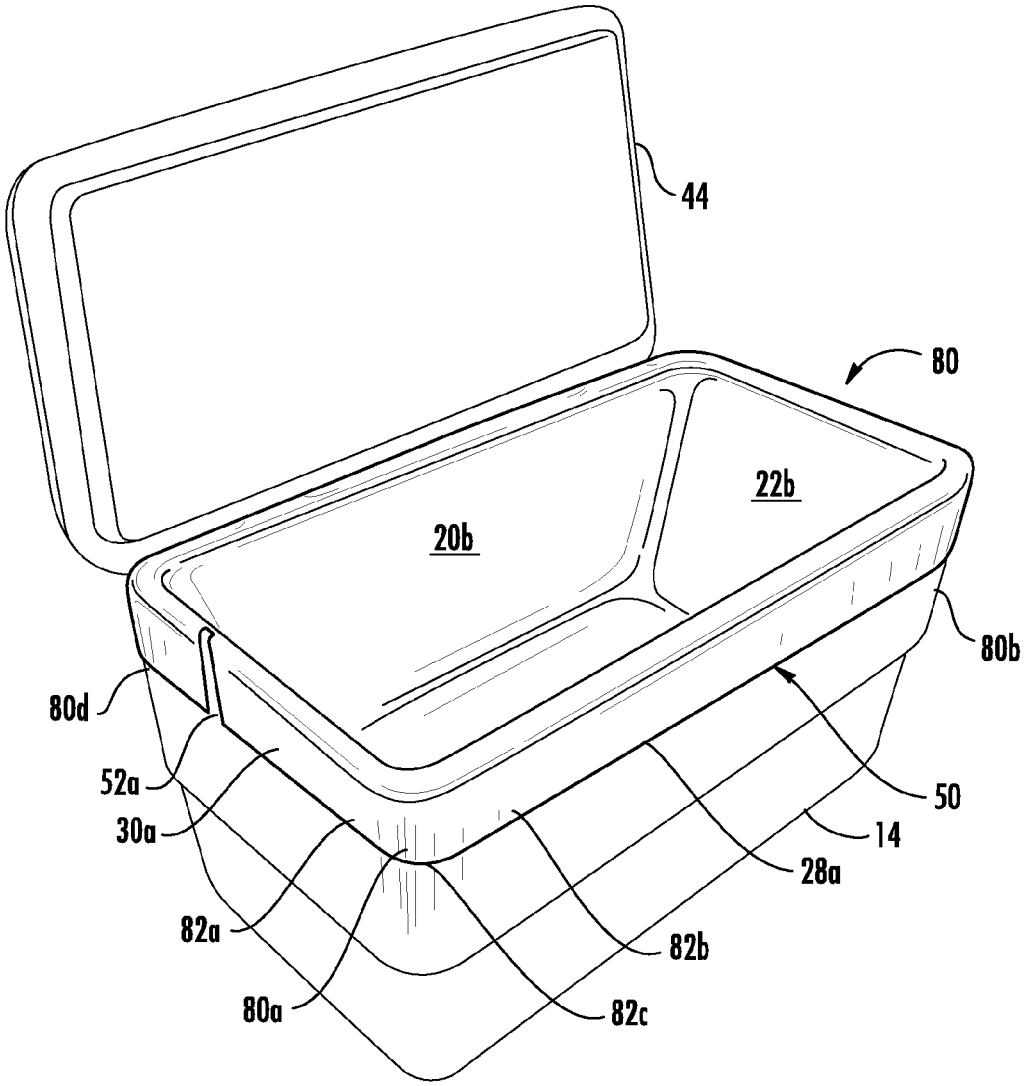
FIG. 28 is a perspective view of a fourth embodiment of a liner according to the present invention.
Figure 29:
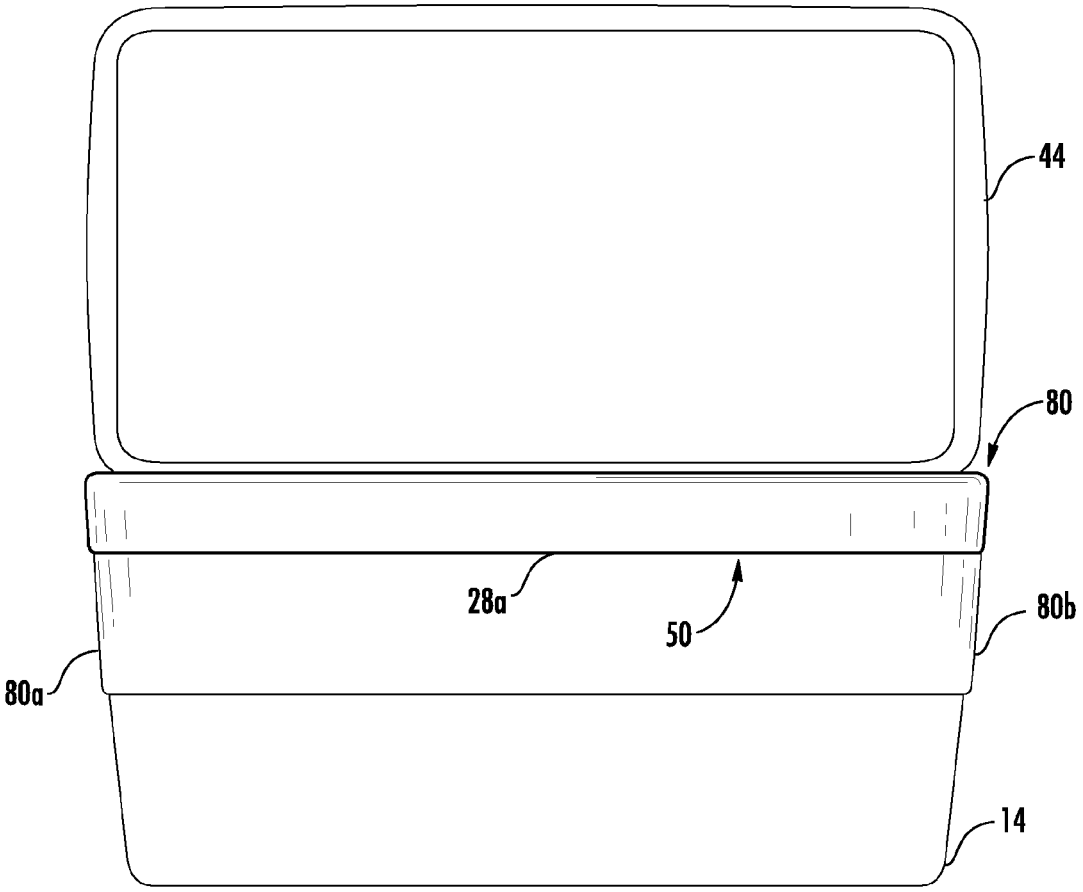
FIG. 29 is an elevational view of the front side of the liner of FIG. 28.
Figure 30:
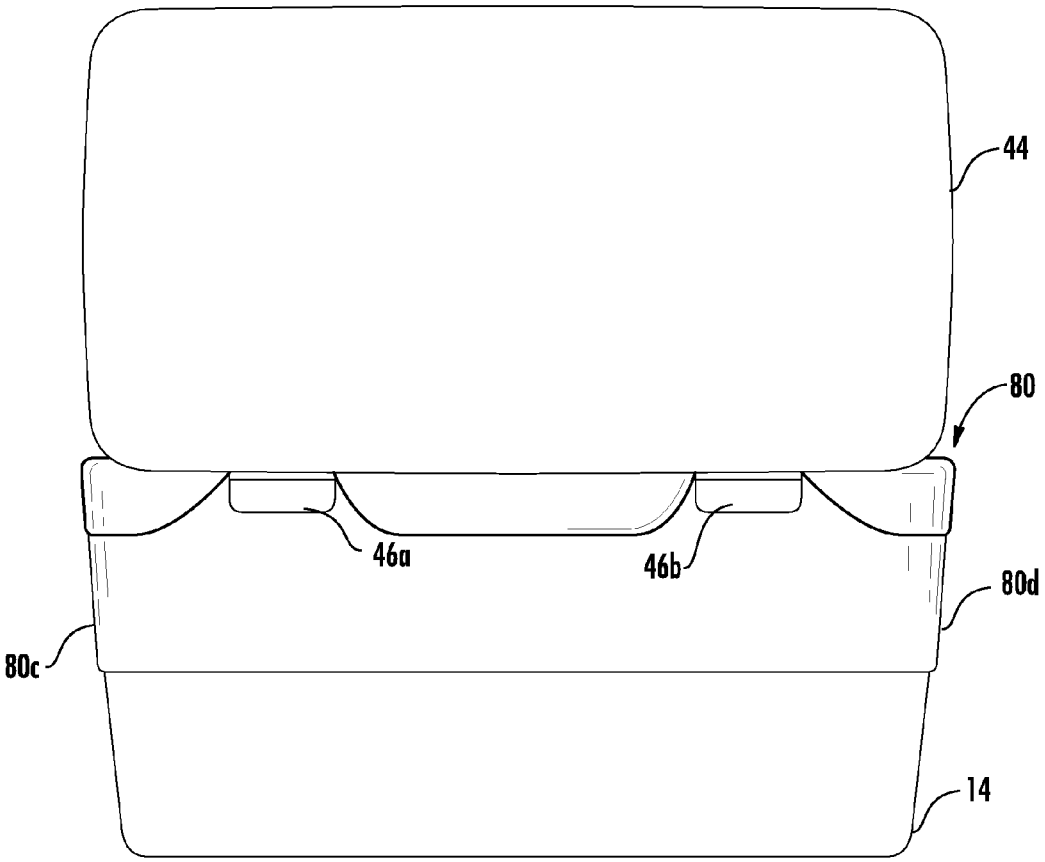
FIG. 30 is an elevational view of the rear side of the liner of FIG. 28.
Figure 32:
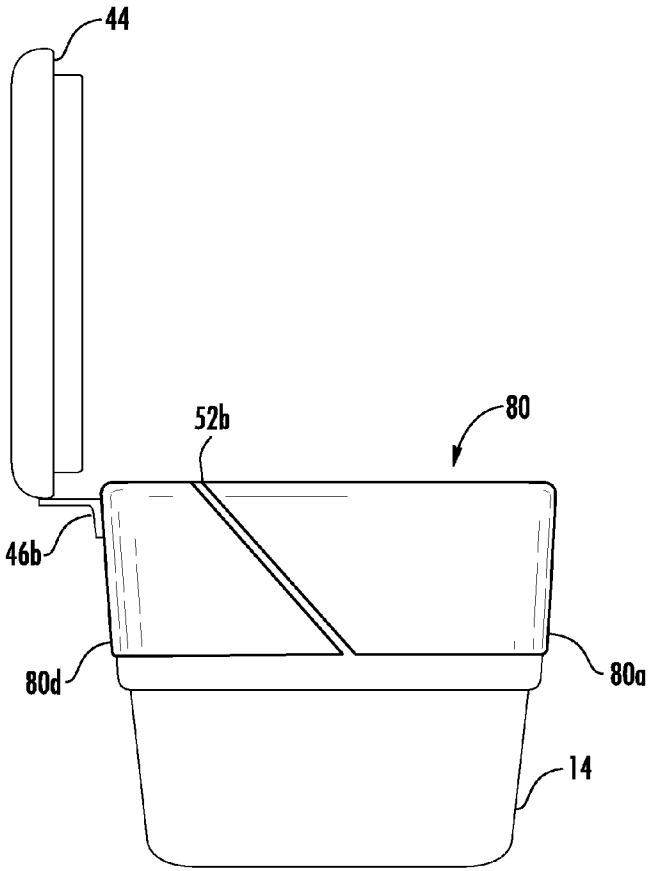
FIG. 32 is an elevational view of the left side of the liner of FIG. 28.
Figure 31:
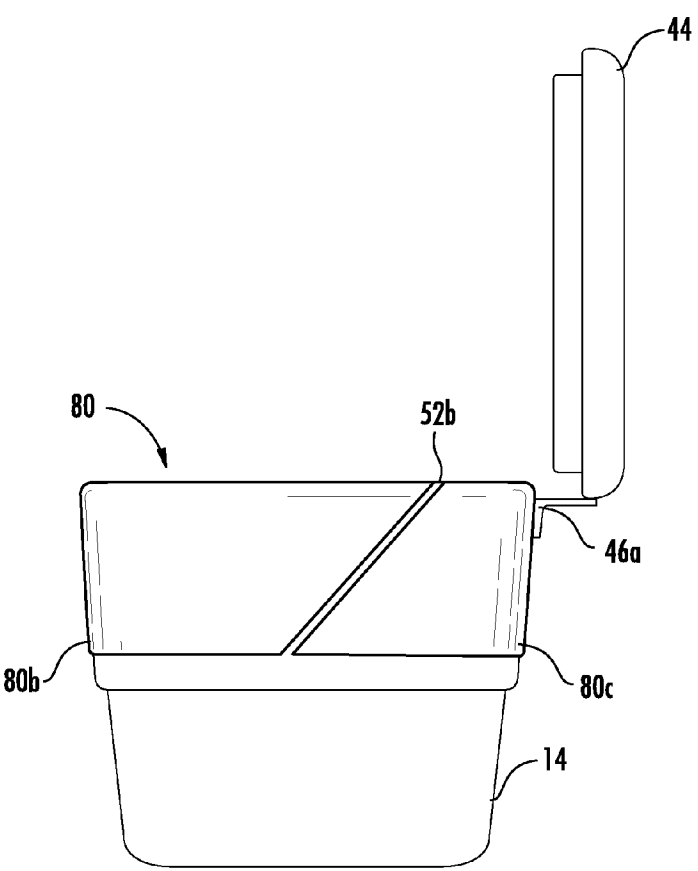
FIG. 31 is an elevational view of the right side of the liner of FIG. 28.
Figure 33:
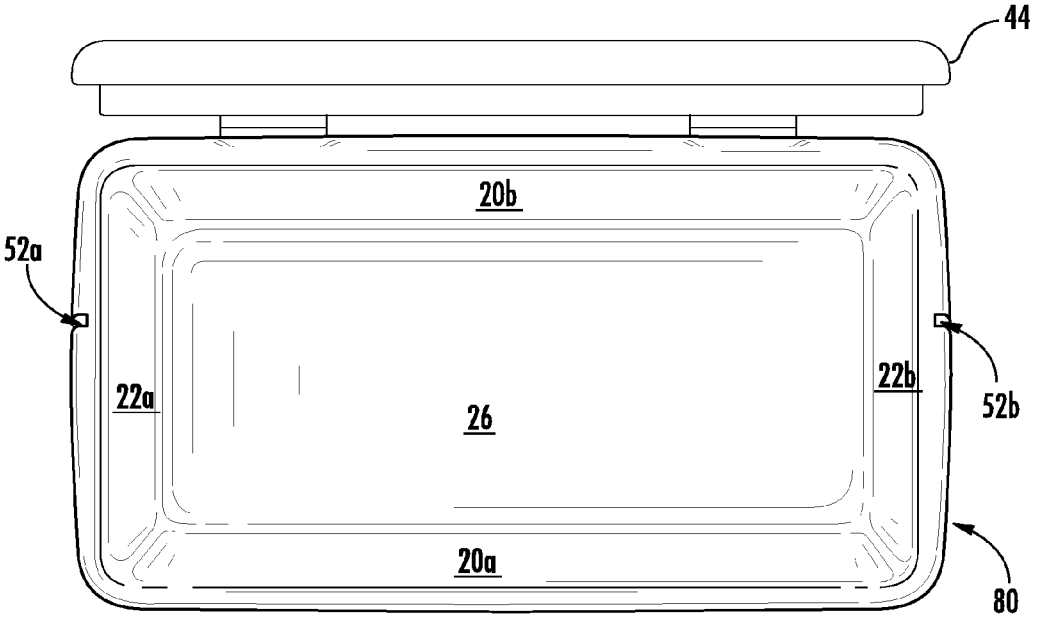
FIG. 33 is a plan view of the top side of the liner of FIG. 28.
Figure 34:
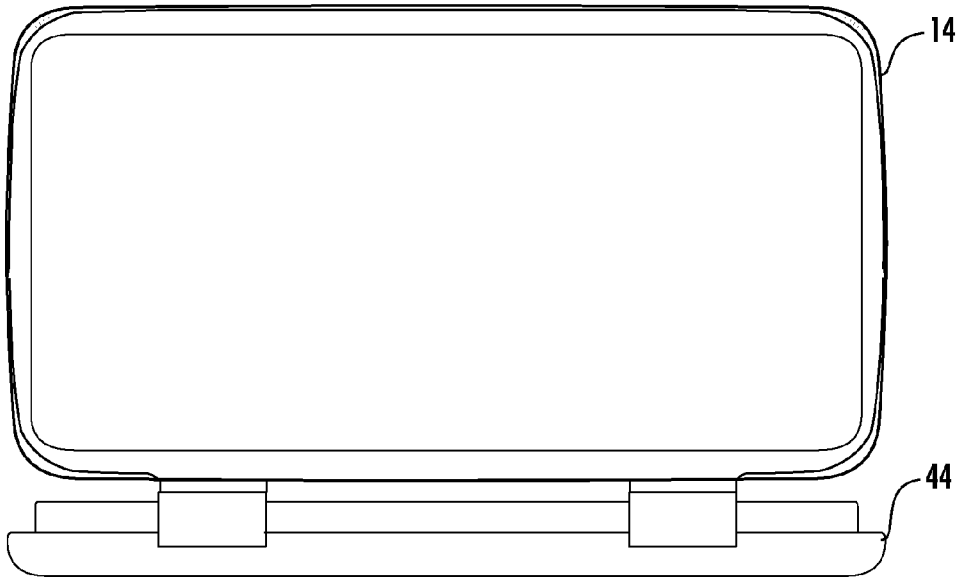
FIG. 34 is a plan view of the bottom side of the liner of FIG. 28.
Figure 35:
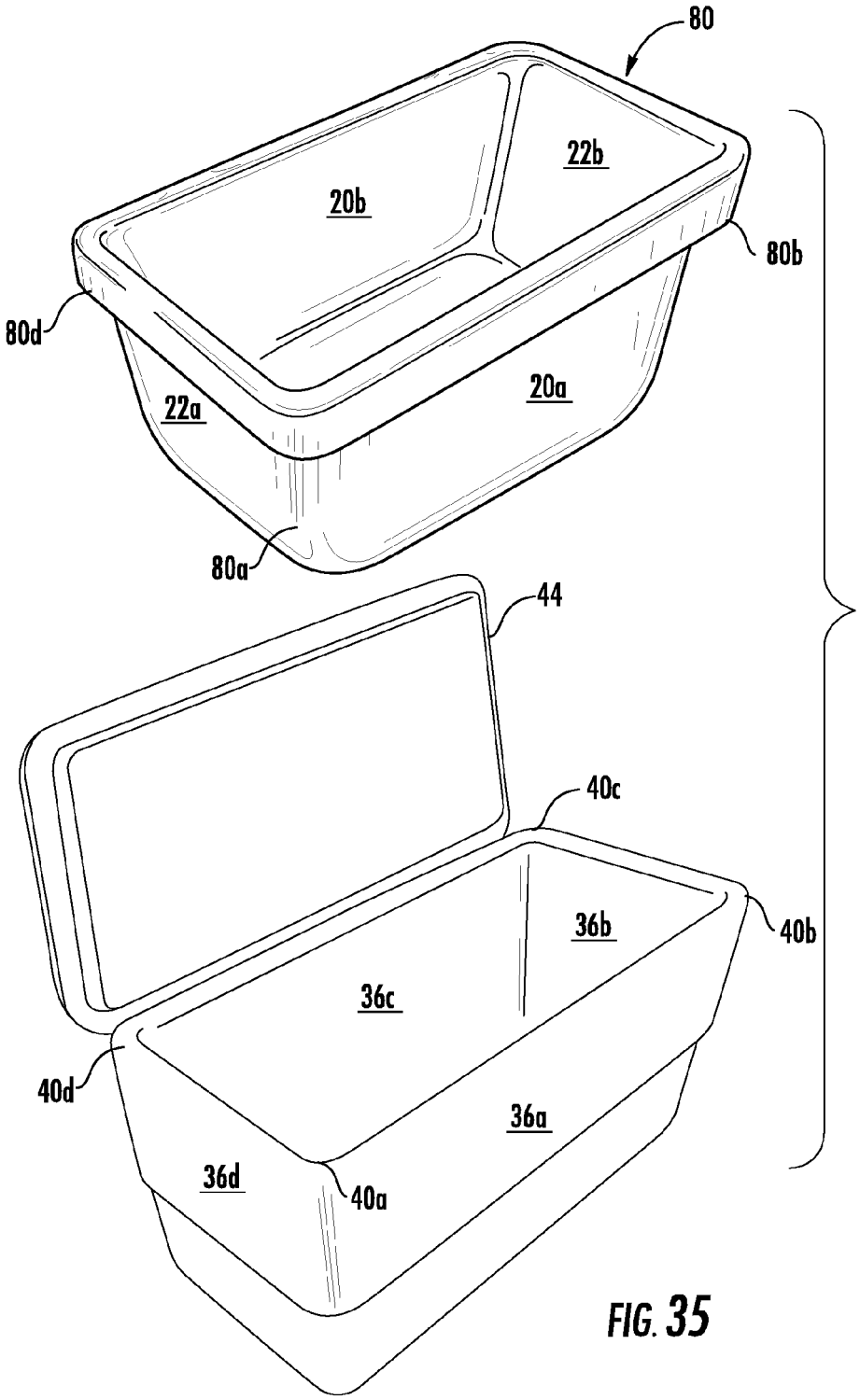
FIG. 35 is an exploded, perspective view of the liner of FIG. 28 viewed from an upper perspective.
Figure 36:
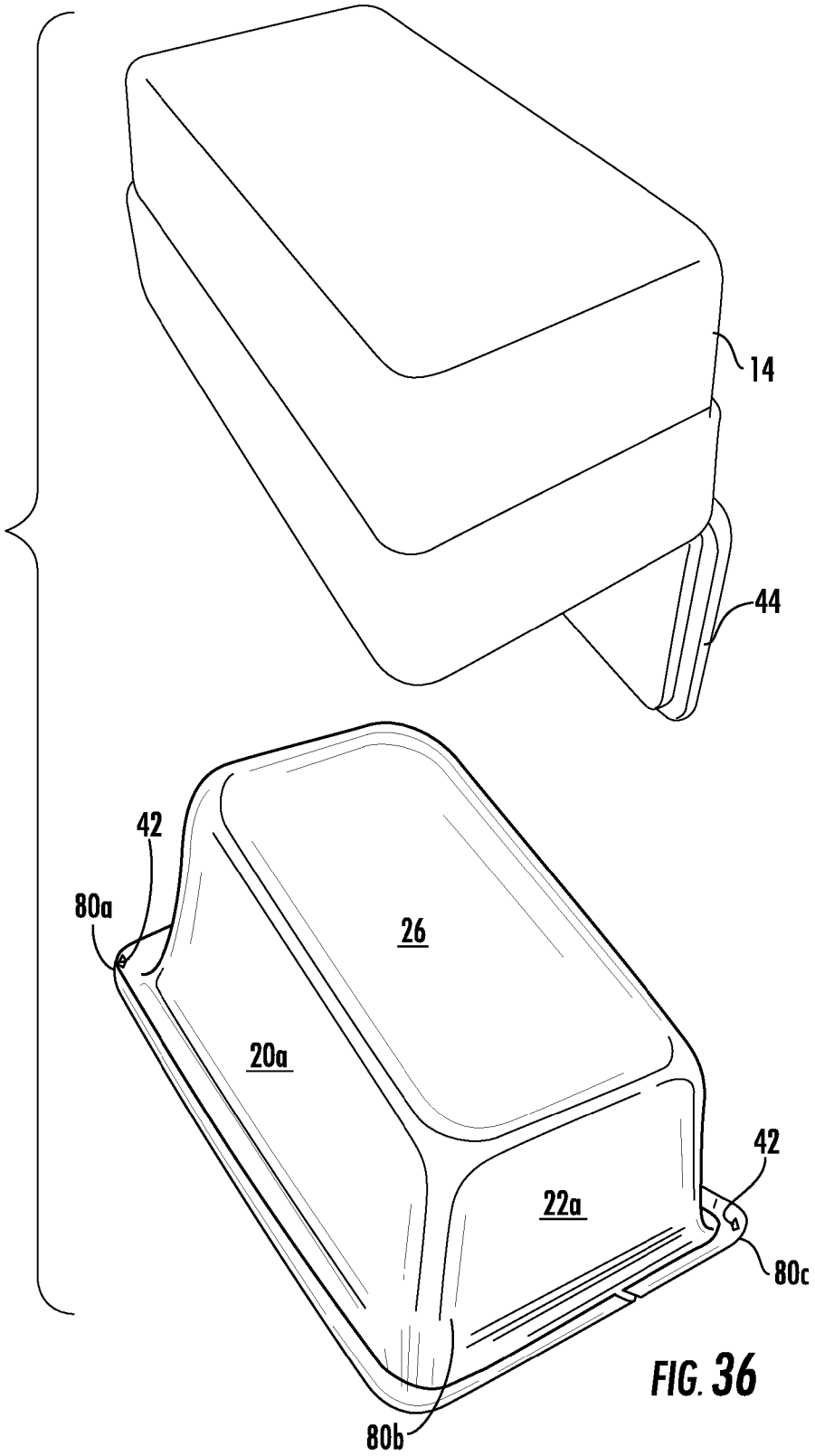
FIG. 36 is an exploded, perspective view of the liner of FIG. 28 viewed from a lower perspective.

As is known, some coolers include restraints connecting the lid of the cooler to the body of the cooler to limit the extent that lid is separated from the cooler when opened. For example, as illustrated in FIG. 1, the lid 44 of the cooler 14 could have straps (not shown) on opposed sides of the lid for connecting to the cooler. To accommodate for such straps, in some embodiments, the liner 10 may include slots 52*a*,52*b* respectively located in second opposed sides 30*a*,30*b* of the liner 10. (Note that while FIGS. 1-27 show all corners having slots 52*a*,52*b*, depending on the embodiment, one, two, three, four or all could have slots 52*a*,52*b* but not all liners are required to have such slots). With reference to FIG. 5, the slot 52*a* is located near the back wall 36*c* of the cooler 14 (i.e., nearer the corner 32*d* of the liner 10 than the corner 32*a* of the liner). The slot 52*a* comprises opposing first and second slot sides 54*a*,54*b* extending from the perimeter 50 of the second opposed side 30*a* of the liner. The first slot side 54*a* extends at an acute angle X from the second opposed side 30*a* of the liner toward the back corner 32*d* of the liner. The second slot side 54*b* extends at an obtuse angle Y from the second opposed side 30*a* of the liner toward the back corner 32*d* of the liner. In other words, the slot defined by the slot sides 54*a*,54*b* extend at an acute angle from the second opposed side 30*a* of the liner toward the back corner 32*d* of the liner to accommodate from a strap, if any, of the cooler connecting the lid to the cooler. As illustrated in FIG. 6, the slot sides 54*a*,54*b* terminate at distal side 56 in the liner 10. The length of the slot from second opposed side 30*a* of the liner to the distal side 56 is chosen so that the distal side 56 of the slot does not extend into the cavity 34 (see FIG. 8) of the cooler so as to minimize seepage about the slot distal side 56.

Figure 4:
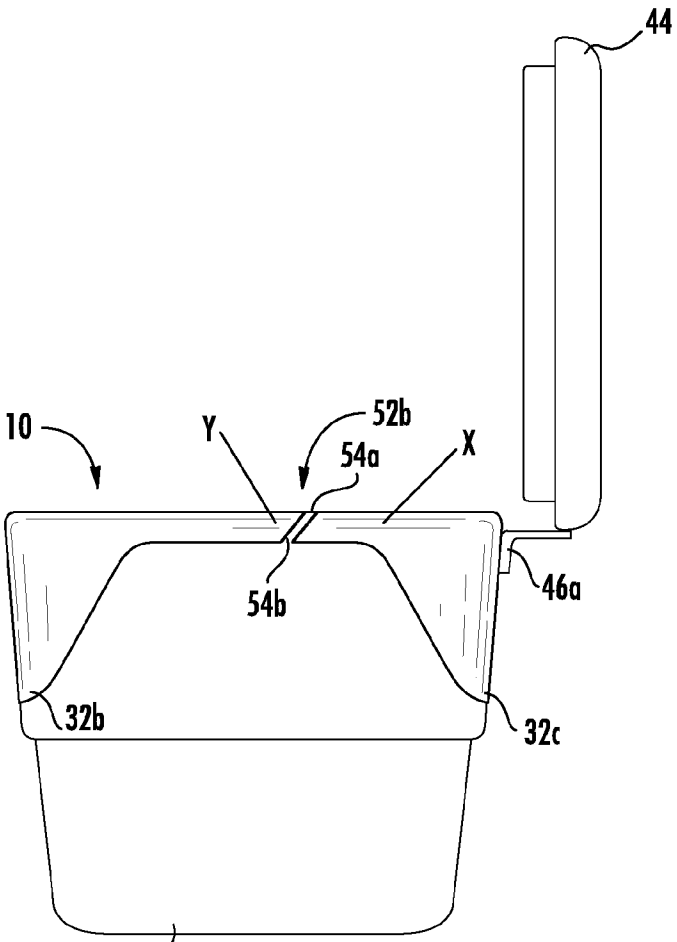
FIG. 4 is an elevational view of the right side of the liner of FIG. 1.

As illustrated in FIG. 4, the slot 52*b* is located near the back wall 36*c* of the cooler 14 (i.e., nearer the corner 32*c* of the liner 10 than the corner 32*b* of the liner). The slot 52*b* comprises opposing first and second slot sides 54*a*,54*b* extending from the perimeter 50 of the second opposed side 30*b* of the liner. The first slot side 54*a* extends at an acute angle X from the second opposed side 30*b* of the liner toward the back corner 32*c* of the liner. The second slot side 54*b* extends at an obtuse angle Y from the second opposed side 30*b* of the liner toward the back corner 32*c* of the liner. In other words, the slot defined by the slot sides 54*a*,54*b* extend at an acute angle from the second opposed side 30*b* of the liner toward the back corner 32*c* of the liner to accommodate from a strap, if any, of the cooler connecting the lid to the cooler. As illustrated in FIG. 6, the slot sides 54*a*,54*b* terminate at distal side 56 in the liner 10. The length of the slot from second opposed side 30*b* of the liner to the distal side 56 is chosen so that the distal side 56 of the slot does not extend into the cavity 34 (see FIG. 8) of the cooler so as to minimize seepage about the slot distal side 56.

As will be understood, the liner may be of any color, such as white or black, or may be opaque or transparent. Further, any pattern, logo, advertisement, instructions for use, picture, image, etc. may be printed on the liner for view by a user. As an example, the liner could be white so as to match the inside permanent lining of a typical cooler. The liner could be in the form of a pattern such as camouflage, tartan, checkered, etc. The liner may include logos, such as corporate, college, sports team, or other organization. The liner may include depictions, such as balloons, flowers, etc. Instructions for use could also be printed on the liner. As illustrated in FIGS. 1-9, a logo 61, message, etc. could be printed on an inside portion of the liner that overlaps the sides of the cooler, so that the logo is visible in use.

It is understood that the liner could be manufactured with various thicknesses depending on the proposed application of use. Generally, a thicker liner would be used to ensure that it does not rupture or puncture in use. Thicknesses in the range of 1 to 3 mil are contemplated with 1 to 2 mil thicknesses being common.

FIGS. 10-18 depict a liner 60 according to a second embodiment of the present invention. As illustrated the liner 60 is similar to the liner 10 of the embodiment depicted in FIGS. 1-9 regarding the structure of various aspects of the liner 60. A difference exists in the shape/configuration of the corners 60*a*-60*d* of the liner 60. In the embodiment of the liner 10 of FIGS. 1-9, the liner 10 has corners 32*a*-32*d* with a perimeter 48 defined by opposed sides 48*a*,48*b* that intersect at a point 48*c*. In the embodiment of the liner 60 of FIGS. 10-18, the liner 60 has corners 60*a*-60*d* with a perimeter 62 defined by opposed sides 62*a*,62*b* that intersect with a distal side 62*c* to thereby form a squared shape. The squared corners 60*a*-60*d*, at a minimum, provide added surface area to secure the liner 60 to the cooler 14.

FIGS. 19-27 depict a liner 70 according to a third embodiment of the present invention. As illustrated the liner 70 is similar to the liner 10 of the embodiment depicted in FIGS. 1-9 regarding the structure of various aspects of the liner 70. A difference exists in the shape/configuration of the corners 70*a*-70*d* of the liner 70. In the embodiment of the liner 10 of FIGS. 1-9, the liner 10 has corners 32*a*-32*d* with a perimeter 48 defined by opposed sides 48*a*,48*b* that intersect at a point 48*c*. In the embodiment of the liner 70 of FIGS. 19-27, the liner 70 has corners 70*a*-70*d* with a perimeter 72 defined by curved portions 72*a*,72*b*,72*c* to form a circular/curved shaped end.

FIGS. 28-36 depict a liner 80 according to a fourth embodiment of the present invention. As illustrated the liner 80 is similar to the liner 10 of the embodiment depicted in FIGS. 1-9 regarding the structure of various aspects of the liner 80. A difference exists in the shape/configuration of the corners 80*a*-80*d* of the liner 80. In the embodiment of the liner 10 of FIGS. 1-9, the liner 10 has corners 32*a*-32*d* with a perimeter 48 defined by opposed sides 48*a*,48*b* that intersect at a point 48*c*. In the embodiment of the liner 80 of FIGS. 28-36, the liner 80 has corners 80*a*-80*d* with a perimeter defined by first opposed sides 28*a*,28*b* that intersect with second opposed side 30*a* at opposite corners 80*a*,80*d* respectively. Likewise, first opposed sides 28*a*,28*b* intersect with second opposed side 30*b* at opposite corners 80*b*,80*c* respectively to thereby form a straight edge.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other changes, combinations, omissions, modifications and substitutions, in addition to those set forth in the above paragraphs are possible. Those skilled in the art will appreciate that various adaptations and modifications of the just described embodiments can be configured without departing from the scope and spirit of the invention. Therefore, it is to be understood that, within the scope of the appended claims, the invention may be practiced other than as specifically described herein.

What is claimed is:

1. A liner for a cooler comprising:

a body forming a containment space;

an opening connected to the containment space, wherein the opening is defined by a perimeter having two opposed first sides that both extend along a first axis of the liner and are generally parallel to each other and two opposed second sides that both extend along a second axis of the liner and are generally parallel to each other, wherein the first opposed sides intersect with the second opposed sides to form respective corners, wherein each of the corners extend outwardly from respective opposing sides of the perimeter of the liner, such that each corner has an elongated dimension extending outward from an intersection of a respective first opposed side and a respective second opposed side of the liner.

2. The liner of claim 1, wherein each of the corners has a curved perimeter edge.

3. The liner of claim 1, wherein each of the corners has opposed sides that intersect at a distal point.

4. The liner of claim 1, wherein each of the corners comprises two opposed sides that intersect with a distal side to thereby form a squared shape.

5. The liner of claim 1 further comprising an elongated slot located in at least one of the opposed sides of the opening to thereby accommodate a strap of a cooler connecting a lid to the cooler.

6. The liner of claim 1, wherein the containment space is 28 inches long, 16 inches wide, and 33 inches high.

7. The liner of claim 1, wherein the containment space is 42 inches long, 22 inches wide, and 37 inches high.

8. The liner of claim 1 further comprising an adhesive layer on the outer side of the perimeter.

9. The liner of claim 8, wherein the adhesive layer is located in the corners.

10. The liner of claim 8, wherein the adhesive layer is located along the entire perimeter.

* * * * *